US005154727A

United States Patent [19]

Dyer

[11] Patent Number: 5,154,727

[45] Date of Patent: * Oct. 13, 1992

[54] PROCESS FOR IMPROVING POLYMER FIBER PROPERTIES AND FIBERS PRODUCED THEREBY

[75] Inventor: Michael E. Dyer, Cleveland, Tenn.

[73] Assignee: Intera Corporation, Cleveland, Tenn.

[ * ] Notice: The portion of the term of this patent subsequent to May 10, 2005 has been disclaimed.

[21] Appl. No.: 471,640

[22] Filed: Jan. 29, 1990

Related U.S. Application Data

[63] Continuation of Ser. No. 502,049, Jun. 7, 1983, abandoned, and a continuation-in-part of Ser. No. 426,498, Sep. 29, 1982, Pat. No. 4,743,267, which is a continuation-in-part of Ser. No. 390,732, Jun. 21, 1982, abandoned, which is a continuation-in-part of Ser. No. 296,656, Aug. 27, 1981, abandoned, which is a continuation-in-part of Ser. No. 273,713, Jun. 15, 1981, abandoned, which is a continuation-in-part of Ser. No. 223,056, Jan. 7, 1981, abandoned.

[51] Int. Cl.[5] ..... D06M 13/34

[52] U.S. Cl. ..... 8/194; 8/127.5; 8/128.1; 8/116.1; 8/128.3; 8/115.65

[58] Field of Search ..... 8/115.5, 128 R, 128 A, 8/116.1, 194, 115.58, 115.65, 129; D19/21, 18

[56] References Cited

U.S. PATENT DOCUMENTS 4,743,267 5/1988 Dyer ..... 8/194

*Primary Examiner*—Prince Willis, Jr.

*Assistant Examiner*—John F. McNally

*Attorney, Agent, or Firm*—Oblon, Spivak, McClelland, Maier & Neustadt

[57] ABSTRACT

A method is provided for treating active hydrogen atom-containing polymer fibers or fibrous structures made thereof to permanently improve the antistatic, hygroscopic, dye receptive, soil release, inter-fiber adhesion and bonding, and fabric hand properties of the fibers and structures. The method involves contacting the fibers with an aqueous solution containing at least one unsaturated monomer and having an acid pH and a temperature between about 75° C. and about 100° C. After allowing the solution to uniformly disperse among the fibers, so that the monomer intimately contacts the fiber surfaces, the fiber is affected and has essentially single molecule addition of the monomer pendent to the polymer chain to form a branched polymer, graft polymerization of the monomer on the fiber surface is initiated by a polymerization initiator for the monomer, and the polymerization is continued for a sufficient time to allow substantial graft polymerization of the monomer on the fibers to modify the surface properties of the fibers. The fibers are preferably scoured prior to the treatment process, and after polymerization the fibers are rinsed to remove acid and excess homopolymer prior to dyeing and/or further processing of the fibers. The fibers may be in the form of knitted, woven or nonwoven fabrics, and may include amine-containing and/or hydroxy-containing polymers such as nylon, wool, silk, cotton, cellulosic, acetate and combinations thereof.

31 Claims, No Drawings

PROCESS FOR IMPROVING POLYMER FIBER PROPERTIES AND FIBERS PRODUCED THEREBY

CROSS-REFERENCE TO RELATED APPLICATIONS

This is a continuation of application Ser. No. 502,049, filed on Jun. 7, 1983 now abandoned.

This application is a continuation-in-part of U.S. application Ser. No. 426,498, filed Sep. 29, 1982, now U.S. Pat. No. 4,743,267, which in turn is a continuation-in-part of U.S. application Ser. No. 390,732, filed Jun. 21, 1982, which is in turn a continuation-in-part of U.S. application Ser. No. 296,656, filed Aug. 27, 1981, now abandoned, which is in turn a continuation-in-part of U.S. application Ser. No. 273,713, filed Jun. 15, 1981, now abandoned, which in turn is a continuation-in-part of U.S. application Ser. No. 223,056, filed Jan. 7, 1981, now abandoned. The disclosures of each of these patent applications is incorporated herein by reference.

This application is also related to co-pending U.S. application Ser. No. 364,045, filed Mar. 31, 1982, which is a continuation-in-part of U.S. application Ser. No. 128,062, filed Mar. 7, 1980, now abandoned. The disclosure of Ser. No. 364,045 is incorporated herein by reference.

FIELD OF THE INVENTION

The present invention relates to the treatment of polymer fibers to permanently and substantially improve their hygroscopic, antistatic, dye receptive, and soil release properties, as well as altering the hand of such fibers. More particularly, the invention relates to the treatment of polymer fibers containing active hydrogen atoms to improve their surface properties.

BACKGROUND OF THE INVENTION

With the advent of technology to produce synthetic fibers that serve mankind not only by being more economical and stronger than natural fibers, but also by freeing up much needed agricultural land that heretofore had been needed to grow vast quantities of natural fibers, came a quest for a process that would impart to these synthetic fibers the same beneficial qualities possessed by natural fibers. The major quality that synthetic fibers lack, the one attribute that would make them cool and comfortable like the natural fibers, is the ability to substantially absorb moisture.

Throughout this application the terms "absorb" and "absorption" will be used to refer generally to the hygroscopic properties of the fibers and fabrics made therefrom. However, it will be understood that these terms refer to related hygroscopic properties such as adsorption, moisture transport, wicking, wettability, etc. Thus, although the term "adsorption" may be more appropriate for referring to the attraction of water to the outer surfaces of fibers per se, and the term "absorption" may be more appropriate for referring to the dispersal of moisture in the interstices between the fibers of a fabric, the term "absorption" will be used for convenience to refer to both phenomena.

The present invention satisfies this much sought after quest and provides to synthetic fibers permanent qualities once attributable only to natural fibers such as significant water absorbency, superior dye receptivity and anti-static qualities. At the same time, the present invention allows for the production of synthetic fibers that have superior soil release qualities.

It has been known in the prior art to attempt to graft-polymerize water-soluble monomers such as acrylic acid, acrylamide, and N,N'-methylene-bis-acrylamide (MBA) onto fibers to impart antistatic and water absorption properties to the fibers. However, such attempts at graft polymerization have been problematic due to the inability to obtain substantial or even any graft polymerization, a requirement of a long period of time, the tendency to form large amounts of homopolymers, and difficulties in controlling the process conditions. The raising and control of reaction temperature is extremely critical and sensitive to the formation of excess homopolymers. Excess homopolymers adhere to the inner walls of the processing equipment thus causing both a time and labor-consuming clean-up job. Also, disposal of the residue solution containing a large amount of homopolymers is a source of industrial pollution. Fabrics thus treated in an environment of excessive homopolymers have their surfaces coated with a thick homopolymer layer which imparts moisture-absorption and some antistatic properties to the fibers. Unfortunately, these properties are not permanent and are lost within about ten washings. Furthermore, excessive homopolymers tend to cause blotching on treated fabrics which interferes with acceptable commercial dyeing and results in inferior treated fabrics.

In an alternative polymerization process that comprises impregnating fibers with a solution containing a monomer and a polymerization initiator, such as peroxide or persulfate, and heating them, it takes a long period of time to start and advance the polymerization reaction; moreover, the polymers that adhere to fibers are removed quite easily by washing so that their antistatic and moisture-absorption properties can no longer be retained.

Still another process involves applying a water-soluble vinyl monomer together with a polymerization initiator to fibrous structures and heating them in a non-solvent of the monomer, such as hydrocarbons or the like. Such process has problems of industrial hygiene and workability including solvent recovery.

U.S. Pat. No. 3,313,591 to Tanner describes a process of graft polymerizing ethylenically unsaturated monomers to polycarbonamides to improve various properties of the polymer structure. Tanner uses a one step process using very long time durations (15 hours or more) and very high concentrations of monomer.

A more recent attempt to cure the deficiency in the prior art is disclosed in U.S. Pat. No. 4,135,877 to Aikawa et al. This patent also discloses a one step process of graft polymerizing certain selected vinyl monomers to polyamides or fiber structures. According to the process described in that patent, polymerization initiators are completely eliminated.

Other patents disclosing the graft polymerization of monomers to polyamides and other polymer structures include U.S. Pat. Nos. 3,097,185; 3,099,631; 3,252,880 and 3,278,639. However, the methods of these patents involve the use of ionizing radiation in the formation of a polymer melt in order to effect graft polymerization.

While many of these processes of the prior art result in improved antistatic, hygroscopic and dye receptive properties in the polymer, they have not been entirely successful commercially due to the difficulties in obtaining permanent and substantial results and other processing difficulties due to excessive formation of homopolymers which are difficult to remove from the final product and process equipment. Furthermore, some prior art methods require high concentrations of monomer, rather than low concentrations of monomer; and other prior art methods require long periods of time.

The possibility of improving such properties of synthetic fabrics in general, including but not limited to polyamides, is important since many of these fabrics exhibit characteristically undesirable properties such as static cling poor water absorbency, and poor dye receptivity. Hence, the commercial acceptance of nylon fabrics, for example, has been severely limited. Heretofore, I am aware of no commercially successful process which has resulted in a treated fiber having substantially improved antistatic, hygroscopic, and dye receptive properties which are permanent and can withstand repeated washings.

The principal object of the present invention is to provide a unique process and a product of that process which alleviates the past shortcomings of attempted graft polymerization.

The present invention is unique in that the process can be completed in very short periods of time, using a low concentration of chemicals, is not sensitive to changes in temperature, and forms relatively minute amounts of homopolymers and allows commercial products to be made which can be dyed and otherwise processed.

The product of the present invention is unique in that it is the first that has grafted onto fibers an economical, commercial, permanent, clean, and low add-on graft polymer.

Although the treatment method of this invention is particularly useful for nylon, which is not naturally absorbent and is subject to static electricity problems, it is also beneficial to enhance the properties of absorbent fibers such as cotton. Treating a blend consisting of cotton and synthetic fibers in accordance with the method of this invention may allow the use of less cotton in the blend to achieve a comparable fabric.

SUMMARY OF THE INVENTION

According to the present invention, polymer fibers or fibrous structures made thereof (hereinafter simply referred to as "polymer fibers") containing active hydrogen atoms are treated with a heated acidic solution of at least one unsaturated monomer, followed by polymerization of the monomer with a polymerization initiator in order to modify the surface characteristics of the polymer fibers. The treatment process comprises essentially three steps: (1) the polymer fibers are contacted with an aqueous solution having a pH below 7 but above where acid degradation of the polymer fiber occurs, and a temperature between about 75° C. and about 100° C. and containing at least one unsaturated monomer. In the first step, the surface of the polymer fiber is affected and has essentially single molecule addition of a monomer pendent to the polymer fiber. The solution is preferably agitated or forced to flow among the fibers for a sufficient time to allow uniform dispersal and intimate contact of the monomer with the fiber surfaces. (2) Thereafter polymerization of the monomer on the polymer fiber surfaces is initiated using a polymerization initiator, such as a persulfate or peroxide compound. (3) Then, the polymerization is continued for a sufficient time to allow substantial graft polymerization of the monomer on the fiber surfaces to modify the surface characteristics of the polymer fibers.

With most vinyl monomers and most synthetic polymer fibers the maximum weight percent of add-on graft polymer should be below about 1.0%. Thus, additional graft polymer above 1.0% is rapidly lost on washing.

With most vinyl monomers and natural polymer fibers, such as cotton, which are porous, the graft polymer add-on may go up to below about 2 weight percent.

It is usually disadvantageous to exceed these weight percent values of add-on polymer, since to do so may result in splotches on the outer surface of fabric formed from the polymer fibers, as well as material waste, cleanliness and pollution problems. The time duration for the first step of monomer attachment to the surface may vary between one second and thirty minutes. Longer durations may be used than thirty minutes. However, such longer durations will normally not significantly improve the monomer attachment.

The polymer fibers should not be degraded. Conditions resulting in polymer fiber degradation are to be avoided. By way of example, high concentrations of acrylic acid and other monomers may lead to degradation of the polymer fibers.

The polymer fibers are preferably immersed in the treating solution, usually in the form of a knitted, woven or nonwoven fabric, and many variations are possible in the order of addition of the various components to the treating solution. A preferred monomer for use in the invention is N,N'-methylene-bis-acrylamide. The pH of the solution may be adjusted by addition of an acid or by use of an acid monomer. The treatment is preferably carried out at low concentrations of monomer and polymerization initiator and for short periods of time so as to avoid as much as possible substantial homopolymerization of the monomer.

The fibers are preferably scoured prior to the treatment process to clean the fibers and remove surface chemicals which may interfere with the graft polymerization of the monomer on the fiber surfaces. Dyeing of the fibers is preferably carried out after the treatment process and after rinsing the fibers to remove acid and excess homopolymers which would otherwise interfere with the dyeing.

The fibers resulting from the process of the present invention have substantially improved water absorbency, dye receptivity, antistatic, soil release, inter-fiber adhesion and bonding properties, and fabric hand properties. The fibers so treated by the present invention will retain their enhanced properties even when subject to many vigorous washings.

DETAILED DESCRIPTION OF THE INVENTION

Polymer fibers having active hydrogen atoms to which the present invention is directed include both natural and synthetic polymers. The source of such active hydrogen atoms can be amine or hydroxy groups. Non-limiting examples of natural polymers suitable for treating according to the present invention include wool, cotton and silk. Non-limiting examples of synthetic polymers suitable for treatment according to the present invention include nylon, and cellulosic fibers, e.g., rayon and acetate. The treatment of polyesters and acrylics is covered by my copending application Ser. No. 426,498, filed Sep. 29, 1982 now U.S. Pat. No. 4,743,267.

Non-limiting examples of polymer fibers containing an amine $(-\overset{|}{N}H$ or $-NH_2$) group include nylon 6,6, nylon 6, wool and silk. Non-limiting examples of polymer fibers containing a hydroxy (—OH) group include cotton, rayon, and acetate.

The subject invention concerns the treating of polymer fibers per se and fibrous structures made thereof. The term "fibrous structures" includes continuous filaments, multifilament threads, batts, staple fibers, woven or knitted fabrics, and non-woven fabrics, and the like composed of at least one kind of the fibers mentioned above. As used herein, the term "polymer fibers" will be understood to include fibrous structures such as the above and others. Wherever the present disclosure refers to fiber surfaces or intimate contact of the monomer with fiber surfaces or like expressions, it will be understood that the individual fibers of filaments are being referred to, such that contact and attachment of the monomer and graft polymer is with the surfaces of individual filaments of a multifilament thread or bundle, for example.

Preferred polymers for use in the present invention are the polyamides, particularly the synthetic linear condensation polyamides containing a carbonamide unit as a linking unit in the main polymer chain. Such polyamides include for example poly(hexamethylamine adipamide), which is prepared by the well known reaction of polycarboxylic acid such as adipic acid (or an amide-forming derivative thereof) with a polyamide such as hexamethylene diamine. The most common commercially available polyamides of this type in the United States are nylon 6,6 which is polyhexamethylene adipamide, and nylon 6 which is poly(hexamethylene carprolactam). These types of nylons are commonly extruded as monofilaments over a wide dimensional range, oriented by cold-drawing and knitted into many different forms of fabrics. Nylons are excellent fabrics and can be produced very cheaply on a mass production basis, but nylon suffers from many drawbacks. Nylon lacks the ability to absorb water and is subject to static electricity problems. By treating nylon according to the process of the present invention, a most useful fabric is formed which has very good water absorbing, dye receptive, and antistatic properties which are retained after many washings.

The temperature at which fibers or fibrous structures are treated in accordance with the present invention is between about 75° C. and about 100° C., preferably between about 80° C. and about 90° C. for amine containing polymers and between about 85° C. and about 100° C. for hydroxy containing polymers.

The process of the present invention differs from those of the prior art in that polymerization of the monomer to be graft polymerized onto the polymer fibers is delayed until there has been intimate contact of the monomer and acid with the surface of the heated polymer fiber. Thus, while applicant does not wish to be bound by any particular theory or mechanism of reaction, it is believed that the unsaturated monomer first attaches to the polymer chain on a molecule by molecule basis in the presence of acid and heat. Thereafter, when the polymerization is initiated by addition or activation of a polymerization initiator, the monomer begins to polymerize so that there is chain addition of monomer to the sites of single monomer additions initially grafted onto the polymer fibers. If significant homopolymerization of the monomer takes place prior to the alteration and monomer attachment to the fibers, most of it will simply be washed off the fibers so that there will be no significant permanent improvement in the surface properties of the fibers.

Accordingly, the first step of the method according to the present invention comprises the formation of an aqueous treating solution with dissolved monomer having an acidic pH (i.e. below about 7 and above a pH where acid degradation occurs) and heated to a temperature of about 75° C. to about 100° C. and preferably in the range of about 80° C. to 90° C. for amine containing polymers and preferably about 85° C. to about 100° C. for hydroxy containing polymers, such as cotton, rayon and acetate. While temperatures above 100° C. are possible, they make processing more difficult and may make subsequent polymerization difficult to control.

It is not necessary that the temperature be constant throughout the first step or throughout the process. For example, the treating solution could be formed at about 70° C., or such temperature as will allow ready dissolving of the monomer and/or acid in the solution, and then the temperature could be raised to the desired level for the attachment of the monomer just prior to initiation of graft polymerization. The attachment of a monomer should be such as to effect essentially single molecule addition of the monomer pendent to the polymer chain to form a branched polymer with substantially no graft polymerization of said monomer. This single molecule addition is disclosed in my copending patent application Ser. No. 6/364,045 filed Mar. 31, 1982, the disclosure of which is incorporated herein by reference. Thus, since graft polymerization is to be avoided, it is not necessary to add any polymerization initiators, and the acid and heat are normally sufficient to induce the cleavage of the carbon-carbon double bond and the formation of carbene radicals. Moreover, in the case of acrylamide and other monomers having a low degree of reactivity, it is also not normally necessary to use a polymerization inhibitor in the treating solution. While applicant does not wish to be bound by any particular theory, it is believed that the acid may also act as a polymerization inhibitor as well as a catalyst for the reaction. That is, it is believed that the anions from the acid react with some of the carbene radicals to terminate the reaction and prevent significant polymerization. However, with some monomers which more rapidly polymerize upon the formation of carbene radicals, it may be necessary to include in the treating solution one or more polymerization inhibitors, which are known in the art for the particular monomer selected.

Those of ordinary skill in the art will recognize that the proper extent of treatment can be determined by detecting the onset of homopolymerization of the monomer in the treatment solution. Thus, since graft polymerization is normally accompanied or preceded by homopolymerization of the monomer, which homopolymerization appears as a precipitate or cloudiness in the treatment solution, the formation of homopolymers should be avoided in the first step. Of course, while the present invention seeks to obtain essentially single molecule additions of the monomer to the polymer chains, it will be understood that there will inevitably be some amounts of graft dimerization and/or trimerization on the polyamides and in the treatment solution. Theoretically, there can be a maximum addition of one molecule to every six units of the polymer chain in the case of nylon 6,6 or nylon 6. However, accurate determinations of the exact numbers of additions are difficult on a simple weight basis since nylon picks up about 5 percent water, and the total addition of monomer to a polymer is generally too small to measure. In one case the monomer addition was measured as less than 0.03 percent by weight.

Although the prefered practice of the present invention seeks to obtain essentially single molecule addition of the monomer to the polymer chains in the first step of the process, the addition of dimers and trimers of the monomer is also satisfactory. Therefore, as used in the present specification and claims, the term "essentially single molecule addition" will be understood to include additions of single, double and triple molecules of the monomer to the polymer chains in the first step of the process. Significant additions of anything larger than trimers would be considered graft polymerization and is therefore to be avoided.

The temperature in the second step is maintained at whatever level is necessary to obtain the optimum speed and degree of graft polymerization. For example, the temperature could be maintained at the same temperature as the first step or could be raised to about 85° C. or 90° C. at the end of the first step and maintained at that temperature for the remainder of the treatment process. Generally, there would normally be no occasion in which the temperature in the second step is below the temperature of the first step.

The acid, monomer, fabric and heat may be combined in the first step of the treatment process in virtually any desired order, so long as each of these four elements is present prior to initiating polymerization for a sufficient time to allow uniform dispersal and intimate contact of the monomer with the fiber surfaces. For example, the order of combination in the first step may be any of the following: (1) addition of acid and monomer to water, addition of a delayed initiator (to be activated in the second step), and heating to the desired temperature; (2) addition of monomer and a delayed initiator to water, addition of acid and heating to the desired temperature; (3) addition of monomer to water, heating to desired temperature and addition of acid and delayed initiator; or (4) addition of acid, monomer to water, addition of delayed initiator and heating to desired temperature. Other possible orders of carrying out the first step will be evident to those skilled in tha art based on the present disclosure.

Uniform dispersal and intimate contact may be assisted by various forms of agitation or flow of the aqueous treating solution around and between the fiber surfaces. For example, in the case of the treatment of fibers in the form of fabric piece goods, agitation may be accomplished by the paddles in a conventional paddle tub. Alternatively, for fibers in the form of fabrics which are processed in the form of rolls on a beam, the aqueous treating solution may be circulated around and through the beam by conventional pressure means.

The time necessary for attaining uniform dispersal intimate contact and attachment of the monomer to the polymer fibers will vary with the particular method of contacting the fibers with the aqueous solution, and may range from one second to thirty minutes. Although it is possible that the aqueous solution could be contacted with the fibers by spraying, paddling, dipping or other means, it is most preferable to immerse the fibers in a bath formed by the aqueous solution. Using such immersion techniques, relatively short periods of time are necessary before polymerization may begin. For example, about 10 minutes is usually sufficient with adequate agitation or circulation of the aqueous solution.

After uniform dispersal, intimate contact and attachment of the monomer to the polymer fibers have been achieved, graft polymerization of the monomer on the fibers may be commenced with the use of a suitable polymerization initiator such as peroxide or persulfate compounds which are known in the art. The particular initiator selected will depend upon the particular polymer fiber, the particular monomer used and the speed or other conditions of the polymerization desired. The weight ratio of initiator may range from about 5000 parts by weight of monomer to 1 part by weight of initiator up to about one part by weight of monomer to 20 parts by weight of initiator. Preferably, the weight ratio should be about 9 to 0.67 parts by weight of monomer per one part by weight of initiator. Increasingly the amount of initiator above the aforementioned weight ratio of 0.67 parts by weight of monomer to one part by weight of initiator confers minimal improvement to the process. If desired, the initiator may be added during the first step so long as it is not activated until uniform dispersal, intimate contact and attachment of the monomer with the fiber surfaces are achieved. The initiation of polymerization may then be carried out, such as by raising the temperature, changing the pH or changing some other condition which will activate the initiator.

Finally, the polymerization is allowed to continue until there has been substantial graft polymerization of the monomer on the polymer fibers to modify the surface properties of the fibers. Generally, a rather low degree of polymerization is desirable, since excessive polymerization will result in large amounts of homopolymer in the fibers and in the process equipment, which must be cleaned and washed out after completion of the process. Therefore, it is preferable to avoid polymerization which significantly clouds the treating solution, and such small polymers as will remain in solution are preferred.

To this end, it is preferable to carry out the process of the present invention using very low concentrations of monomer, such as in the range of about 0.01 to about 1.0 weight percent of the total solution and preferably about 0.02 to 0.5 weight percent of the solution. Such low concentrations allow easy control of the polymerization reaction so that a relatively clear solution is maintained throughout the process, and the processing equipment and fibers treated may be easily cleaned and washed out.

It appears that the add-on of graft polymer should be below 1.0 weight percent for synthetic fibers using MBA and N,N$^1$-(1,2 dihydroxyethylene)-bis-acrylamide (glyoxal acrylamide) and below 2.0 weight percent for natural fibers. Optimum processing according to the present invention results in the permanent add-on of about 0.6 weight percent or even less of graft polymer based upon the weight of the polymer fiber.

While the process of the present invention may be used at any of a number of stages during the usual processing of polymer fibers or fabrics or other structures made from such fibers, it has been found preferable to use the process before the dyeing of the fibers or before there is any treatment of the fibers which would result in encapsulation or coating of the fiber surface. Thus, it is usual practice to encapsulate or "lock on" the dye or other fiber treatment chemicals, and such coatings will often interfere with the addition of the monomer to the polymer fiber. To the extent that there would still be addition, this would be gradually washed off through many washings.

Therefore, it is preferable that the fibers be scoured (e.g. washed with detergent) and rinsed prior to carrying out the treatment process of the present invention in order to remove dirt and other chemicals which may be present on the fibers. The process may then be carried out before dyeing or even in the dye bath but before the after treatment to set the dye. However, it is preferable to drain the treating solution and rinse the fibers before dyeing, in order to remove acid and excess homopolymer, which may interfere with reaction of the dye with the dye sites on the surface of the polymer fibers.

Whereas many of the teachings of the prior art such as Aikawa and Tanner involved the treating of fibers in the absence of polymerization initiators to avoid homopolymerization, the present invention employs polymerization initiators. Polymerization initiators are generally of four basic types, namely, peroxides, persulfates, acids and ceric compounds.

Non-limiting examples of polymerization initiators that may possibly be utilized in this invention include inorganic peroxides, e.g., hydrogen peroxide, barium peroxide, magnesium peroxide, etc., and various organic peroxy compounds illustrative examples of which are the dialkyl peroxides, e.g., diethyl peroxide, dipropyl peroxide, dilauryl peroxide, dioleyl peroxide, distearyl peroxide, di-(tert.-butyl) peroxide and di-(tert.-amyl) peroxide, such peroxides often being designated as ethyl, propyl, lauryl, oleyl, stearyl, tert.-butyl and tert.-amyl peroxides; the alkyl hydrogen peroxides, e.g., tert.-butyl hydrogen peroxide (tert.-butyl hydroperoxide), tert.-amyl hydrogen peroxide (tert.-amyl hydroperoxide), etc.; symmetrical diacyl peroxides, for instance peroxides which commonly are known under such names as acetyl peroxide, propionyl peroxide, lauroyl peroxide, stearoyl peroxide, malonyl peroxide, succinyl peroxide, phthaloyl peroxide, benzoyl peroxide, etc.; fatty oil acid peroxides, e.g., coconut oil acid peroxides, etc.; unsymmetrical or mixed diacyl peroxides, e.g., acetyl benzoyl peroxide, propionyl benzoyl peroxide, etc.; terpene oxides, e.g., ascaridole, etc.; and salts of inorganic peracids, e.g., ammonium persulfate and potassium persulfate.

When fibers are treated according to this invention, the reaction may also be initiated by ceric ions, for example, in the form of ceric salts such as ceric nitrate, ceric sulfate, ceric ammonium nitrate, ceric ammonium sulfate, ceric ammonium pyrophosphate, ceric iodate, and the like.

Non-limiting examples of suitable acids for use in the present invention include hydrochloric, phosphoric, sulfuric, nitric, acetic, formic, oxalic, tartaric, monochloroacetic, dichloroacetic, trichloroacetic and similar acids. Formic and hydrochloric acid have been found to be particularly suitable in carrying out the present invention. It is possible that an acid can function as both a catalyst and initiator, e.g., formic acid.

Non-limiting examples of unsaturated types of monomers that may possibly be utilized in this invention include N,N'methylene-bis-acrylamide ($CH_2(NHCOCH{:}CH_2)_2$), N,N'-(1,2 dihyroxyethylene)-bis-acrylamide, acrylamide, acrylic acid, 2-propyn-1-ol, crotonic acid, tetraethylene glycol, styrene, alpha-methyl styrene, 1,1-diphenyl ethylene, alpha-vinyl naphthalene, vinylpyridine, 2-chloro-2,3-butadiene, methacrylic acid, methacrylamide, N-methylolacrylamide, N-methyl-N-vinyl formamide, N-vinyl pyrrolidone, 3-, 4- or 5-methyl-N-vinyl pyrrolidone, vinyl oxyethylformamide, methyl acrylate, ethyl acrylate, octyl methyl methacrylate, vinylacrylate, acrylonitrile, methacrylonitrile, acrylyl chloride, vinyl methyl ketone, methallylalcohol, acrolein, methacrolein, vinyl acetate, p-vinyl phenyl acetate, methylmethacrylate, vinyl chloride, vinylidene chloride, p-chlorostyrene, 2,5-dichlorostyrene, 1,1,7-trihydro-perfluoroheptyl acrylate, methyl alphachloroacrylate, acrylyl cyanide, styrene sulfonic acid, salts and esters of styrene sulfonic acid and glycidyl methacrylate. The preferred monomers are N,N'-methylene-bis-acrylamide (MBA) and N,N'(1,2 dihydroxyethylene)-bis-acrylamide.

A monomer may function as an acid. MBA, for example, is slightly acidic in aqueous solution. It is also possible to use specially modified monomer which can provide special characteristics to the fibers, or fabrics made therefrom, such as crease softness, lubricity (e.g. by including silicon groups on the monomer), adhesion, optical brightness, anti-bacterial, anti-fungal or anti-mildew properties, etc.

In a preferred embodiment of this invention with the monomer utilized selected from the group consisting of MBA and N,N'(1,2 dihydroxyethylene)-bis-acrylamide, and the polymer fibers are nylon 66, or nylon 6, the graft polymerization step of the process is conducted for a period of time between about 0.5 minutes and about 2 hours, preferably between about 1.0 minute and about 30 minutes, at a temperature of about 80° C. to 90° C. The amount of initiator in the treating solution is between about $1\times10^{-4}$ weight percent and 5.0 weight percent.

An illustrative preferred embodiment would be to immerse the fibers in an aqueous solution at about 70° C. containing about 0.01 weight percent hydrochloric acid or about 0.03 weight percent formic acid, and about 0.04 weight percent MBA, rapidly raising the temperature of the solution to about 90° C. and agitating the fibers in the solution for about 10 minutes. Thereafter, about 0.02 weight percent of potassium persulfate is added to the solution to initiate polymerization. The polymerization is continued for about 10 minutes, followed by draining the solution from the fibers and rinsing the fibers in water, all weight percents being on the basis of percentage by weight of the total solution.

The particular concentrations of the monomer, acid and the initiator in the treating solution will vary widely depending upon such factors as the nature of the particular monomer, acid and initiator, the time and temperature of the treatment, and the nature and form of the fiber being treated. While certain concentrations may be fairly essential for a particular monomer, acid and initiator under a given set of treatment conditions, applicant cannot give general ranges which would apply to all monomers, acids and initiators under all conditions, but those of ordinary skill in the art will be able to optimize the concentrations by routine experimentation on the basis of the present disclosure.

Attaining the desired degree of treatment according to this invention would depend on the strength of the initiator and the concentration of the monomer and acid. Thus, for example, a strong initiator, one that is inherently strong and/or having a high concentration of initiator, would require a lower monomer concentration. Conversely, a weak initiator, one that is inherently weak and/or having a low concentration of initiator, would require a higher monomer concentration. In the latter case, the treatment according to this invention can be controlled by draining the initiator containing solution from the fabric once the desired extent of polymerization has been achieved.

After polymerization begins, such polymerization being a function of the concentration and type of the acid, the unsatured monomer, fabric, initiator and the speed and type of the agitation equipment being used, the polymer fibers are allowed to remain in solution at the required temperature long enough to assure that uniform graft polymerization ("substantial polymerization") has occurred, such time usually not exceeding 30 minutes. The fibers can then be rinsed to neutralize the pH and remove excess homopolymers, if any.

The invention will now be described in greater detail by reference to the following specific, non-limiting examples. The examples which follow are laboratory examples. For ease of performance in the laboratory, in many of the examples, the amount of the monomer was present in a higher concentration than would be used commercially. This was done for convenience, such as to facilitate rapid polymerization. The excess homopolymer was discarded. Conventionally, the amount of monomer would be dropped so as to minimize the loss of homopolymer.

In the data, there are a number of cases where the add-on is given as "0". This does not indicate that there was no add-on, but merely that such an add-on was not measureable with the equipment available to the applicant. Indeed, in some of the laboratory runs the final weight was below the initial weight, because the add-on was so low that it was below the weighing errors.

Routine skill could achieve the optimal commercial concentrations of monomer which would vary with the type of apparatus used, and the polymerization conditions that could be achieved with such apparatus in a given facility.

EXAMPLES 1-197

The following fabrics were treated in accordance with the method of the present invention in Examples 1-155:

(1) nylon 6,6
(2) cotton
(3) nylon 6
(4) wool
(5) silk
(6) cellulosic fibers (rayon)
(7) cellulosic fibers (acetate)

The fabric samples were vigorously hand washed with "IVORY" soap in tap water. The fabrics were then rinsed, dried and heated. While the fabric samples were still warm, they were weighed and the initial "drop test" (Init. Drop Test) was then performed. The weight (Init. Wt.) of the fabric was recorded. All samples were weighed in grams on a OHAUS, triple beam balance or a Mettler PC 180 scale.

The "drop test" consisted of using a common medicine dropper to place one drop of tap water onto the fabric sample from a height of approximately one inch above the fabric. After the water was dropped on the fabric, comparative observations were made as to the interaction between the fabric and the water. The scale of the drop test was relatively subjective and is as follows:

Very Poor—Fabric repels the water, i.e., waterproof
Poor—Water beads on fabric
Fair—Water will wet fabric
Good—Water will wick slowly
Very Good—Water will wick moderately
Excellent (Exc.)—Water wicks very quickly Each fabric sample was then placed into a one liter glass beaker containing reaction solution containing a specified amount of either tap or distilled water. Distilled water was used when high concentrations of monomer and elevated temperatures could possibly cause premature polymerization. All water volumes were measured in milliliters with a plus or minus five percent error. To complete the reaction solution, a monomer and acid catalyst were added. The reaction solution was raised to a specified temperature by a hot plate with simultaneous agitation of the solution. The solution was allowed to stabilize (attain uniform pH and monomer concentration through) for about 60 seconds or more before initiator was introduced.

The catalysts that were used included formic acid (98%), concentrated hydrochloric acid (33%), and ferrous sulfate. Unless otherwise indicated on the Tables herein, the acid utilized refers to formic acid.

The monomers introduced into the reaction solution were chosen from the following:

(1) NBA: N,N'-methylene-bis-acrylamide, heretofore referred to as "MBA"
(2) NEBA: N,N'-(1,2 dihydroxyethylene)-bis-acrylamide, heretofore referred to as "glyoxal acrylamide"
(3) NBA/DMS: reaction product of NBA and dimethyl sulfate
(4) NEBA/DMS: reaction product of NEBA and dimethyl sulfate
(5) NBA/MCA: reaction product of NBA and monochloroacetic acid
(6) NEBA/MCA: reaction product of NEBA and monochloroacetic acid
(7) NBA/Formic: reaction product of NBA and 98% formic acid
(8) NEBA/Formic: reaction product of NEBA and 98% formic acid
(9) Acrylamide
(10) Acrylic Acid
(11) 2-propyl-1-ol
(12) Crotonic Acid
(13) Tetraethylene Glycol After solution stabilization, an initiator was introduced into the reaction solution. The initiator was selected from the following:

A. Peroxide—30% hydrogen peroxide
B. Persulfate—potassium persulfate
C. Ceric—Ceric Ammonium Nitrate
D. Formic—98% formic acid
E. Sodium Peroxide
F. HCl After polymerization began (onset of cloudiness in solution indicated polymerization), the fabric samples were allowed to remain in solution at the specified temperature until "substantial polymerization" occurred. The time to achieve "substantial polymerization" was between about 7 seconds and about 4 minutes depending upon several factors. The time interval from the addition of the initiator to the onset of cloudiness is referred to herein as "time to polymerize".

After "substantial polymerization" occurred, the sample was removed and vigorously washed with "IVORY" soap, then rinsed, dried and heated.

While each sample was still warm, the weight of the fiber was recorded. Then the final drop test was conducted. The percentage weight gain for each sample was calculated as follows:

$$\% \text{ add-on } (\% \text{ weight gain}) = \frac{(\text{Final Weight of fabric} - \text{Initial Weight of fabric})}{\text{Inital Weight of fabric}} \times 100$$

The results for Examples 1–197 are given in Table 1 hereinbelow.

Tables 2–21 hereinbelow summarize some of the results given in Table 1.

It is very difficult to present the data pointing up the effect of a single variable. Thus, varying one variable may result in the necessity to vary other variables as the variables are interrelated. Thus, a change in temperature will cause the same concentration of monomer and polymerization initiator to react differently.

Table 2 illustrates the variation of one variable, namely the presence of acid at different temperatures and initiator concentrations. The results are in the columns "Percent Add-On" and "Time To Polymerize".* Table 2 presents four (4) pairs, each showing the effect of acid.

* In the Tables the results are "Percent Add-On", "Time To Polymerize" and/or "Final Drop Test".

In Table 3, the first three examples are a comparative group, and the next three examples are a comparative group, with the final example being illustrative of no acid and low initiator. In Table 3 the acid is used as a catalyst, and the effect of initiator is shown. However, the chart also shows, which is why the last example is inserted, that the time can be varied to produce excellent results. This shows the interrelationship of the separate variables.

Table 4 demonstrates that at different concentrations, different monomers work if one varies some of the variables, such as acid concentration, or weight percent initiator.

Table 5 shows the effect of temperature in relation to different monomers, the data being presented in pairs with preferred temperature being compared to inoperative temperature in each pair.

Table 6 shows that poor results are always obtained below the threshold temperature of about 75° C. not withstanding changes in the initiator, the type and weight percent monomer, the presence of acid catalyst and the time to polymerize. As heretofore noted, acid is not needed when the monomer itself is acid as in these examples.

Table 7 shows the effect of changes in temperature with NBA. The "Time To Polymerize" was not recorded in some instances. The weight percentage concentration of the monomer was varied as this was necessary to obtain a reaction.

Tables 8 and 9 likewise show the effect of variation in temperature with different monomers. The concentration of the monomer had to be adjusted to enable the reaction to go forward.

Tables 10 and 11 show the effect of temperature increments with different initiators. It is clear that the threshold temperature of 75° C. is vital.

Tables 12 through 21 correspond to the preceding Tables 2 through 11 except that the fabric is cotton, whereas Tables 2 through 11 deal with nylon 6,6 as the fabric.

EXAMPLES 198–207

Examples 198–207 illustrate the permanency of enhanced qualities imparted to fabrics treated according to the present invention.

Preweighed, scoured, heat set nylon 6,6 and cotton fabric received an initial drop test. Two samples (one nylon 6,6 sample and one cotton sample) weighing approximately 60–70 g were put into a 5 liter stainless steel vessel containing 3 liters of tap water heated to a temperature of 95° C. to 100° C. by a hot plate. The solution contained 50 g of N,N'methylene-bis-acrylamide and 50 ml of formic acid. After 30 seconds, an initiator (potassium persulfate) was added to induce polymerization. After the solution remained cloudy for 30 seconds, the samples were removed, washed, dried, heated and weighed. Both the nylon 6,6 and the cotton samples were subjected to a wash test in a standard home washing machine that consisted of a 10 minute cycle of agitation in 55° C. tap water containing 30 g of "TIDE" home laundry detergent. The water was then extracted and the samples were subjected to a warm rinse cycle with agitation and then a final water extraction (spin cycle). The samples were weighed after 2, 5, 10 and 15 washings. Table 22 lists the percentage weight gain (% add-on) found after each washing.

Table 22, given hereinbelow, clearly shows that fibers treated according to the present invention continue to have considerable percentage add-on of polymer even after a great number of washings. Since the percentage add-on is a reflection of the enhanced water absorbent and antistatic properties imparted to fabrics treated in accordance with this invention, it is clear that fabrics so treated are afforded permanent enhanced properties. The results shown in Table 22 are plotted in the Figure accompanying this specification.

EXAMPLE 208

Example 208 illustrates the beneficial soil release properties imparted to fabrics treated in accordance with the present invention.

Two pieces of Nylon 6,6 fabric were sewn together. One piece was treated in accordance with this invention; the other piece was untreated. The resultant piece of fabric was agitated in a warm aqueous solution of dirt, organic matter, oil, grape juice and mustard. It was then washed in a standard home washer with detergent. There was a substantial difference in fabric appearance. The side treated in accordance with the invention had a slight off-white appearance and the other side (untreated fabric) was stained brown with black specks.

TABLE 1

| Ex. No. | Fabric | Monomer | Amt. of Monomer, g. | Amt. of Acid, ml | Vol. of Water, ml | Temp., °C. | Initiator | Amt. of Initiator | Time to Polymerize | Init. Wt., g | Init. Drop Test | Final Wt., g | Final Drop Test | % Add-On |
|---|---|---|---|---|---|---|---|---|---|---|---|---|---|---|
| 1 | Nylon 6,6 | NBA | 10 | 20 | 600– | 96–100 | Persulfate | 0.5 g | 0.5 sec. | 3.97 | Poor | 4.10 | Exc. | .7 |

TABLE 1-continued

| Ex. No. | Fabric | Monomer | Amt. of Mono-mer, g. | Amt. of Acid, ml | Vol. of Water, ml | Temp., °C. | Initiator | Amt. of Initi-ator | Time to Polymer-ize | Init. Wt., g | Init. Drop Test | Final Wt., g | Final Drop Test | % Add-On |
|---|---|---|---|---|---|---|---|---|---|---|---|---|---|---|
| 2 | Cotton | NBA | 10 | 20 | 600 | 96–100 | Persulfate | 0.5 g | 0.5 sec. | 3.29 | Good | 3.35 | Exc. | 1.8 |
| 3 | Nylon 6,6 | NBA | 10 | 0 | 600 | 96–100 | Peroxide | 10 ml | 6 min., 15 sec. | 2.44 | Poor | 2.47 | Exc. | 1.2 |
| 4 | Cotton | NBA | 10 | 0 | 600 | 96–100 | Peroxide | 10 ml | 6 min. 15 sec. | 3.18 | Good | 3.21 | Exc. | .9 |
| 5 | Nylon 6,6 | NBA | 10 | 10 | 600 | 96–100 | Peroxide | 10 ml | 2 min. 10 sec. | 3.39 | Poor | 3.44 | Exc. | 1.5 |
| 6 | Cotton | NBA | 10 | 10 | 600 | 96–100 | Peroxide | 10 ml | 2 min. 10 sec. | 3.63 | Good | 3.69 | Exc. | 1.9 |
| 7 | Nylon 6,6 | NBA | 10 | 0 | 600 | 89–93 | Peroxide | 5 ml | 47 min., 43 sec. | 2.60 | Poor | 2.62 | Exc. | .8 |
| 8 | Cotton | NBA | 10 | 0 | 600 | 89–93 | Peroxide | 5 ml | 47 min., 43 sec. | 2.61 | Good | 2.69 | Exc. | 3.1 |
| 9 | Nylon 6,6 | NBA | 10 | 10 | 600 | 89–93 | Peroxide | 5 ml | 6 min., 40 sec. | 2.84 | Poor | 2.86 | Exc. | .7 |
| 10 | Cotton | NBA | 10 | 10 | 600 | 89–93 | Peroxide | 5 ml | 6 min., 40 sec. | 2.59 | Good | 2.63 | Exc. | 1.5 |
| 11 | Nylon 6,6 | NBA | 10 | 0 | 600 | 89–93 | Peroxide | 2.5 ml | 83 min., 20 sec. | 2.94 | Poor | 2.97 | Exc. | 1.0 |
| 12 | Cotton | NBA | 10 | 0 | 600 | 89–93 | Peroxide | 2.5 ml | 83 min., 20 sec. | 2.61 | Good | 2.67 | Exc. | 2.3 |
| 13 | Nylon 6,6 | NBA | 10 | 10 | 600 | 89–93 | Peroxide | 2.5 ml | 10 min., 16 sec. | 3.01 | Poor | 3.04 | Exc. | 1.0 |
| 14 | Cotton | NBA | 10 | 10 | 600 | 89–93 | Peroxide | 2.5 ml | 10 min., 16 sec. | 2.89 | Good | 2.96 | Exc. | 2.4 |
| 15 | Nylon 6,6 | NBA | 10 | 0 | 600 | 88–92 | Peroxide | 1 ml | 139 min., 42 sec. | 4.98 | Poor | 5.01 | Exc. | .6 |
| 16 | Cotton | NBA | 10 | 0 | 600 | 88–92 | Peroxide | 1 ml | 139 min., 42 sec. | 4.74 | Good | 4.85 | Exc. | 2.3 |
| 17 | Nylon 6,6 | NBA | 10 | 10 | 600 | 88–92 | Peroxide | 1 ml | 11 min., 16 sec. | 3.19 | Poor | 3.22 | Exc. | .9 |
| 18 | Cotton | NBA | 10 | 10 | 600 | 88–92 | Peroxide | 1 ml | 11 min., 16 sec. | 2.70 | Good | 2.76 | Exc. | 2.2 |
| 19 | Nylon 6,6 | NBA | 1 | 10 | 600 | 89–92 | Persulfate | .1 g | 35 sec. | 3.05 | Poor | 3.07 | Exc. | .7 |
| 20 | Cotton | NBA | 1 | 10 | 600 | 89–92 | Persulfate | .1 g | 35 sec. | 3.34 | Good | 3.36 | Exc. | .6 |
| 21 | Nylon 6,6 | NBA | 2 | 10 | 600 | 69–70 | Persulfate | .1 g | — | 2.61 | Poor | 2.61 | Poor | 0 |
| 22 | Cotton | NBA | 2 | 10 | 600 | 69–70 | Persulfate | .1 g | — | 5.91 | Good | 5.91 | Good | 0 |
| 23 | Nylon 6,6 | NEBA | 2 | 20 | 600 | 89–92 | Persulfate | .5 g | 4 min., 10 sec. | 3.48 | Poor | 3.51 | Exc. | .9 |
| 24 | Cotton | NEBA | 2 | 20 | 600 | 89–92 | Persulfate | .5 g | 4 min., 10 sec. | 3.50 | Good | 3.52 | Exc. | .6 |
| 25 | Nylon 6,6 | NEBA | 5 | 20 | 600 | 69–70 | Persulfate | 5 g | 40 sec. | 3.28 | Poor | 3.28 | Poor | 0 |
| 26 | Cotton | NEBA | 5 | 20 | 600 | 69–70 | Persulfate | 5 g | 40 sec. | 3.41 | Good | 3.41 | Good | 0 |
| 27 | Nylon 6,6 | NBA/Formic 1:4 | 2 | 10 | 600 | 89–93 | Persulfate | .1 g | 40 sec. | 2.83 | Poor | 2.86 | Exc. | 1.06 |
| 28 | Cotton | NBA/Formic 1:4 | 2 | 10 | 600 | 89–92 | Persulfate | .1 g | 40 sec. | 4.94 | Good | 4.98 | Exc. | .8 |
| 29 | Nylon 6,6 | NBA/Formic 1:4 | 2 | 10 | 600 | 69–70 | Persulfate | .5 g | 2 min., 55 sec. | 3.19 | Poor | 3.19 | Poor | 0 |
| 30 | Cotton | NBA/Formic 1:4 | 2 | 10 | 600 | 69–70 | Persulfate | .5 g | 2 min., 55 sec. | 3.02 | Good | 3.02 | Good | 0 |
| 31 | Nylon 6,6 | NBA/DMS 1:3 | 2 | 10 | 600 | 89–92 | Persulfate | .1 g | 57 sec. | 3.70 | Poor | 3.75 | Exc. | 1.4 |
| 32 | Cotton | NBA/DMS 1:3 | 2 | 10 | 600 | 89–92 | Persulfate | .1 g | 57 sec. | 3.44 | Good | 3.49 | Exc. | 1.5 |
| 33 | Nylon 6,6 | NBA/DMS 1:3 | 2 | 10 | 600 | 69–70 | Persulfate | .5 g | 3 min., 4 sec. | 2.70 | Poor | 2.70 | Poor | 0 |
| 34 | Cotton | NBA/DMS 1:3 | 2 | 10 | 600 | 69–70 | Persulfate | .5 g | 3 min., 4 sec. | 2.85 | Good | 2.85 | Good | 0 |
| 35 | Nylon 6,6 | NBA/MCA 1:2 | 2 | 10 | 600 | 89–92 | Persulfate | .05 g | 1 min., 13 sec. | 3.03 | Poor | 3.07 | Exc. | 1.3 |
| 36 | Cotton | NBA/MCA 1:2 | 2 | 10 | 600 | 89–92 | Persulfate | .05 g | 1 min., 13 sec. | 3.14 | Good | 3.18 | Exc. | 1.3 |
| 37 | Nylon 6,6 | NBA/MCA 1:2 | 2 | 10 | 600 | 69–70 | Persulfate | 1.5 g | 2 min., 10 sec. | 2.9 | Poor | 2.9 | Poor | 0 |
| 38 | Cotton | NBA/MCA 1:2 | 2 | 10 | 600 | 69–70 | Persulfate | 1.5 g | 2 min., 10 sec. | 3.52 | Good | 3.52 | Good | 0 |
| 39 | Nylon 6,6 | NEBA/FORMIC 1:4 | 3 | 20 | 600 | 89–92 | Persulfate | .5 g | 7 min., 44 sec. | 3.20 | Poor | 3.22 | Exc. | .6 |

TABLE 1-continued

| Ex. No. | Fabric | Monomer | Amt. of Mono-mer, g. | Amt. of Acid, ml | Vol. of Water, ml | Temp., °C. | Initiator | Amt. of Initi-ator | Time to Polymer-ize | Init. Wt., g | Init. Drop Test | Final Wt., g | Final Drop Test | % Add-On |
|---|---|---|---|---|---|---|---|---|---|---|---|---|---|---|
| 40 | Cotton | NEBA/ FORMIC 1:4 | 3 | 20 | 600 | 89-92 | Persulfate | .5 g | 7 min., 44 sec. | 3.62 | Good | 3.64 | Exc. | .6 |
| 41 | Nylon 6,6 | NEBA/ FORMIC 1:4 | 3 | 20 | 600 | 69-70 | Persulfate | 1 g | 4 min., 30 sec. | 2.58 | Poor | 2.58 | Poor | 0 |
| 42 | Cotton | NEBA/ FORMIC 1:4 | 3 | 20 | 600 | 69-70 | Persulfate | 1 g | 4 min., 30 sec. | 2.4 | Good | 2.4 | Good | 0 |
| 43 | Nylon 6,6 | NEBA/ MCA 1:3 | 25.6 | 1 ml (HCl) | 500 | 89-92 | Persulfate | 1 g | 10 sec. | 1.546 | Poor | 1.556 | Exc. | .6 |
| 44 | Cotton | NEBA/ MCA 1:3 | 25.6 | 1 ml (HCl) | 500 | 89-92 | Persulfate | 1 g | 10 sec. | 1.819 | Good | 1.830 | Exc. | .6 |
| 45 | Nylon 6,6 | NEBA/ MCA 1:3 | 25.6 | 1 ml (HCl) | 550 | 69-70 | Persulfate | 1 g | 1 min., 50 sec. | 1.089 | Poor | 1.090 | Poor | 0 |
| 46 | Cotton | NEBA/ MCA 1:3 | 25.6 | 1 ml (HCl) | 550 | 69-70 | Persulfate | 1 g | 1 min., 50 sec. | 1.627 | Good | 2.626 | Good | 0 |
| 47 | Nylon 6,6 | NBA | .05 | 1 ml (HCl) | 500 | 98-100 | Persulfate | 1 g | 45 sec. | 1.204 | Poor | 1.203 | Exc. | 0 |
| 48 | Cotton | NBA | .05 | 1 ml (HCl) | 500 | 98-100 | Persulfate | 1 g | 45 sec. | 1.639 | Good | 1.637 | Exc. | 0 |
| 49 | Nylon 6,6 | NBA | .25 | 20 | 500 | 98-100 | Persulfate | .03 g | 1 min., 50 sec. | 1.255 | Poor | 1.258 | Exc. | .2 |
| 50 | Cotton | NBA | .25 | 20 | 500 | 98-100 | Persulfate | .03 g | 1 min., 50 sec. | 1.484 | Good | 1.483 | Exc. | 0 |
| 51 | Nylon 6,6 | NBA | 50 | 0 | 500 | 89-91 | Peroxide | .15 ml | 0 | 1.377 | Poor | 1.398 | Exc. | 1.5 |
| 52 | Cotton | NBA | 50 | 0 | 500 | 89-91 | Peroxide | .15 ml | 0 | 1.757 | Good | 1.847 | Exc. | 5.1 |
| 53 | Nylon 6,6 | NEBA | 50 | 0 | 500 | 94-96 | Persulfate | .01 g | 20 sec. | 1.174 | Poor | 1.177 | Good | .3 |
| 54 | Cotton | NEBA | 50 | 0 | 500 | 94-96 | Persulfate | .01 g | 20 sec. | 2.107 | Good | 2.370 | Exc. | 12.5 |
| 55 | Nylon 6,6 | NBA/DMS 1:3 | .15 | 1 ml (HCl) | 500 | 98-100 | Persulfate | .1 g | 2 min. | 1.228 | Poor | 1.228 | Exc. | 0 |
| 56 | Cotton | NBA/DMS 1:3 | .15 | 1 ml (HCl) | 500 | 98-100 | Persulfate | .1 g | 2 min. | 1.635 | Good | 1.631 | Exc. | 0 |
| 57 | Nylon 6,6 | NBA/DMS 1:3 | .5 | 1 ml (HCl) | 500 | 98-100 | Persulfate | .1 g | 20 sec. | 1.377 | Poor | 1.377 | Exc. | 0 |
| 58 | Cotton | NBA/DMS 1:3 | .5 | 1 ml (HCl) | 500 | 98-100 | Persulfate | .1 g | 20 sec. | 1.621 | Good | 1.628 | Exc. | .4 |
| 59 | Nylon 6,6 | NBA/DMS 1:3 | 20 | 1 ml (HCl) | 500 | 98-100 | Persulfate | .03 g | 30 sec. | 1.369 | Poor | 1.385 | Exc. | 1.2 |
| 60 | Cotton | NBA/DMS 1:3 | 20 | 1 ml (HCl) | 500 | 98-100 | Persulfate | .03 g | 30 sec. | 1.450 | Good | 1.501 | Exc. | 4.2 |
| 61 | Nylon 6,6 | NEBA | 7.5 | 1 ml (HCl) | 500 | 98-100 | Persulfate | .1 g | 6 sec. | 1.605 | Poor | 1.614 | Exc. | .6 |
| 62 | Cotton | NEBA | 7.5 | 1 ml (HCl) | 500 | 98-100 | Persulfate | .1 g | 6 sec. | 1.561 | Good | 1.569 | Exc. | .5 |
| 63 | Nylon 6,6 | NEBA/ DMS 1:3 | 37.5 | 1 ml (HCl) | 500 | 98-100 | Persulfate | .01 g | 10 sec. | 1.350 | Poor | 1.353 | Exc. | .2 |
| 64 | Cotton | NEBA/ DMS 1:3 | 37.5 | 1 ml (HCl) | 500 | 98-100 | Persulfate | .01 g | 10 sec. | 1.162 | Good | 1.175 | Exc. | 1.1 |
| 65 | Nylon 6,6 | NBA/ FORMIC 1:4 | 3.75 | 1 ml (HCl) | 500 | 98-100 | Persulfate | .01 g | 10 sec. | 1.632 | Poor | 1.648 | Exc. | 1 |
| 66 | Cotton | NBA/ FORMIC 1:4 | 3.75 | 1 ml (HCl) | 500 | 98-100 | Persulfate | .01 g | 10 sec. | 1.652 | Good | 1.724 | Exc. | 4.4 |
| 67 | Nylon 6,6 | NBA/ FORMIC 1:4 | 10 | 1 ml (HCl) | 500 | 98-100 | Persulfate | .01 g | 4 sec. | 1.471 | Poor | 1.474 | Exc. | .2 |
| 68 | Cotton | NBA/ FORMIC 1:4 | 10 | 1 ml (HCl) | 500 | 98-100 | Persulfate | .01 g | 4 sec. | 1.449 | Good | 1.457 | Exc. | .6 |
| 69 | Nylon 6,6 | NBA/ MCA 1:3 | 30 | 20 | 500 | 69-70 | Peroxide (.003 g Fe) | 2.5 ml | — | 1.849 | Poor | 1.849 | Poor | 0 |
| 70 | Cotton | NBA/ MCA 1:3 | 30 | 20 | 500 | 69-70 | Peroxide (.003 g Fe) | 2.5 ml | — | 1.298 | Good | 1.298 | Good | 0 |
| 71 | Nylon 6,6 | NBA/ MCA | 30 | 0 | 500 | 89-91 | Peroxide (.003 g Fe) | 1 ml | — | 1.651 | Poor | 1.660 | Exc. | .5 |

TABLE 1-continued

| Ex. No. | Fabric | Monomer | Amt. of Mono-mer, g. | Amt. of Acid, ml | Vol. of Water, ml | Temp., °C. | Initiator | Amt. of Initi-ator | Time to Polymer-ize | Init. Wt., g | Init. Drop Test | Final Wt., g | Final Drop Test | % Add-On |
|---|---|---|---|---|---|---|---|---|---|---|---|---|---|---|
| | | 1:3 | | | | | | | | | | | | |
| 72 | Cotton | NBA/ MCA 1:3 | 30 | 0 | 500 | 89-91 | Peroxide (.003 g Fe) | 1 ml | — | 1.659 | Good | 1.667 | Exc. | .5 |
| 73 | Nylon 6,6 | NBA/ MCA 1:3 | 30 | 0 | 500 | 69-70 | Formic | 40 ml | No reaction | 1.873 | Poor | 1.873 | Poor | 0 |
| 74 | Cotton | NBA/ MCA 1:3 | 30 | 0 | 500 | 69-70 | Formic | 40 ml | No reaction | 1.682 | Good | 1.682 | Good | 0 |
| 75 | Nylon 6,6 | NBA/ MCA 1:3 | 30 | 0 | 500 | 98-100 | Formic | 40 ml | — | 1.158 | Poor | 1.161 | Exc. | .3 |
| 76 | Cotton | NBA/ MCA 1:3 | 30 | 0 | 500 | 98-100 | Formic | 40 ml | — | 1.516 | Good | 1.520 | Exc. | .3 |
| 77 | Nylon 6,6 | NBA/ MCA 1:3 | 30 | 30 | 500 | 69-70 | Ceric | .1 g | 35 sec. | .976 | Poor | .976 | Poor | 0 |
| 78 | Cotton | NBA/ MCA 1:3 | 30 | 30 | 500 | 69-70 | Ceric | .1 g | 35 sec. | 1.724 | Good | 1.722 | Good | 0 |
| 79 | Nylon 6,6 | NBA/ MCA 1:3 | 30 | 0 | 500 | 89-91 | Ceric | .1 g | 15 sec. | 1.077 | Poor | 1.986 | Exc. | .8 |
| 80 | Cotton | NBA/ MCA 1:3 | 30 | 0 | 500 | 89-91 | Ceric | .1 g | 15 sec. | 1.230 | Good | 1.237 | Exc. | .6 |
| 81 | Cotton | NBA | 10 | 0 | 500 | 98-100 | Formic | 40 ml | — | 1.361 | Good | 1.375 | Exc. | 1.0 |
| 82 | Nylon 6,6 | NBA | 80 | 0 | 500 | 69-70 | Formic | 40 ml | No reac. | 1.441 | Poor | 1.441 | Poor | 0 |
| 83 | Cotton | NBA | 80 | 0 | 500 | 69-70 | Formic | 40 ml | No reac. | 1.478 | Good | 1.478 | Good | 0 |
| 84 | Nylon 6,6 | NBA | 40 | 10 | 500 | 69-70 | Peroxide (.003 g Fe) | 10 ml | 5 min., 20 sec. | 1.250 | Poor | 1.248 | Poor | 0 |
| 85 | Cotton | NBA | 40 | 10 | 500 | 69-70 | Peroxide (.003 g Fe) | 10 ml | 5 min., 20 sec. | 1.736 | Good | 1.732 | Good | 0 |
| 86 | Nylon 6,6 | NBA | 40 | 10 | 500 | 69-70 | Ceric | 2 g | 16 sec. | 1.352 | Poor | 1.354 | Poor | 0 |
| 87 | Cotton | NBA | 40 | 10 | 500 | 69-70 | Ceric | 2 g | 16 sec. | 1.683 | Good | 1.680 | Good | 0 |
| 88 | Nylon 6,6 | NEBA | 20 | 0 | 500 | 98-100 | Formic | 30 ml | — | 1.307 | Poor | 1.324 | Exc. | 1.3 |
| 89 | Cotton | NEBA | 20 | 0 | 500 | 98-100 | Formic | 30 ml | — | 1.343 | Good | 1.359 | Exc. | 1.2 |
| 90 | Nylon 6,6 | NEBA | 20 | 0 | 500 | 89-91 | Peroxide (.003 g Fe) | 5 ml | 25 sec. | 1.254 | Poor | 1.307 | Exc. | 4.2 |
| 91 | Cotton | NEBA | 20 | 0 | 500 | 89-91 | Peroxide (.003 g Fe) | 5 ml | 25 sec. | 1.019 | Good | 1.043 | Exc. | 2.4 |
| 92 | Nylon 6,6 | NEBA | 50 | 10 | 500 | 69-70 | Peroxide (.003 g Fe) | 10 ml | 6 min., 15 sec. | 1.105 | Poor | 1.106 | Poor | 0 |
| 93 | Cotton | NEBA | 50 | 10 | 500 | 69-70 | Peroxide (.003 g Fe) | 10 ml | 6 min., 15 sec. | 1.251 | Good | 1.253 | Good | 0 |
| 94 | Nylon 6,6 | NEBA | 90 | 0 | 500 | 95-97 | Ceric | 6.4 g | — | 1.115 | Poor | 1.130 | Exc. | 1.3 |
| 95 | Cotton | NEBA | 90 | 0 | 500 | 95-97 | Ceric | 6.4 g | — | 1.840 | Good | 1.858 | Exc. | 1.0 |
| 96 | Nylon 6,6 | NEBA | 100 | 20 | 500 | 69-70 | Ceric | 10 g | — | 1.460 | Poor | 1.462 | Poor | 0 |
| 97 | Cotton | NEBA | 100 | 20 | 500 | 69-70 | Ceric | 10 g | — | 1.327 | Good | 1.327 | Good | 0 |
| 98 | Nylon 6,6 | NBA | 10 | 0 | 500 | 89-91 | Ceric | .3 g | 1 min., 15 sec. | 1.633 | Poor | 1.648 | Exc. | .9 |
| 99 | Cotton | NBA | 10 | 0 | 500 | 89-91 | Ceric | .3 g | 1 min., 15 sec. | 1.364 | Good | 1.368 | Good | .3 |
| 100 | Nylon 6,6 | NBA | 10 | 20 | 500 | 65 | Persulfate | .25 g | 6 min., 35 sec. | 1.572 | Poor | 1.574 | Poor | 0 |
| 101 | Nylon 6,6 | NBA | 2 | 1 | 500 | 100 | Persulfate | .03 g | 6 sec. | 1.629 | Poor | 1.636 | Exc. | .4 |
| 102 | Cotton | NBA | 2 | 1 | 500 | 100 | Persulfate | .03 g | 6 sec. | 1.525 | Good | 1.529 | Exc. | .3 |
| 103 | Nylon 6,6 | NEBA | 5 | 20 | 500 | 65 | Persulfate | 2 g | 1 min., 55 sec. | 1.652 | Poor | 1.652 | Poor | 0 |
| 104 | Nylon 6,6 | NEBA | 5 | 20 | 500 | 70 | Persulfate | 2 g | 55 sec. | 1.514 | Poor | 1.514 | Poor | 0 |
| 105 | Cotton | NEBA | 5 | 20 | 500 | 70 | Persulfate | 2 g | 55 sec. | 1.523 | Good | 1.522 | Good | 0 |
| 106 | Nylon 6,6 | NEBA | 5 | 20 | 500 | 73 | Persulfate | 2 g | 48 sec. | 1.500 | Poor | 1.502 | Poor | 0 |
| 107 | Nylon 6,6 | NEBA | 5 | 20 | 500 | 75 | Persulfate | 2 g | 40 sec. | 1.694 | Poor | 1.693 | Very Good | 0 |
| 108 | Nylon 6,6 | NEBA | 5 | 20 | 500 | 77 | Persulfate | 2 g | 20 sec. | 1.381 | Poor | 1.380 | Exc. | 0 |
| 109 | Nylon | NEBA | 2 | 20 | 500 | 80 | Persulfate | .5 g | 58 sec. | 1.654 | Poor | 1.658 | Exc. | .2 |

TABLE 1-continued

| Ex. No. | Fabric | Monomer | Amt. of Mono-mer, g. | Amt. of Acid, ml | Vol. of Water, ml | Temp., °C. | Initiator | Amt. of Initi-ator | Time to Polymer-ize | Init. Wt., g | Init. Drop Test | Final Wt., g | Final Drop Test | % Add-On |
|---|---|---|---|---|---|---|---|---|---|---|---|---|---|---|
| | 6,6 | | | | | | | | | | | | | |
| 110 | Cotton | NEBA | 2 | 20 | 500 | 80 | Persulfate | .5 g | 58 sec. | 1.147 | Good | 1.146 | Good | 0 |
| 111 | Cotton | NEBA | 3 | 20 | 500 | 95 | Persulfate | .5 g | 35 sec. | 1.596 | Good | 1.595 | Good | 0 |
| 112 | Cotton | NEBA | 3 | 20 | 500 | 87 | Persulfate | .5 g | 20 sec. | 1.466 | Good | 1.470 | Exc. | .3 |
| 113 | Nylon 6,6 | NEBA | 3 | 2 | 500 | 90 | Persulfate | .5 g | 10 sec. | 1.879 | Poor | 1.884 | Exc. | .3 |
| 114 | Cotton | NEBA | 3 | 2 | 500 | 90 | Persulfate | .5 g | 10 sec. | 1.702 | Good | 1.714 | Exc. | .7 |
| 115 | Nylon 6,6 | NEBA | 10 | 20 | 500 | 100 | Persulfate | 2 g | — | 1.803 | Poor | 1.813 | Exc. | .6 |
| 116 | Cotton | NEBA | 10 | 20 | 500 | 100 | Persulfate | 2 g | — | 2.003 | Good | 2.025 | Exc. | 1.1 |
| 117 | Nylon 6,6 | NBA/DMS 1:3 | 8 | 10 | 500 | 65 | Persulfate | 2 g | 4 min., 30 sec. | 1.760 | Poor | 1.761 | Poor | 0 |
| 118 | Nylon 6,6 | NBA/DMS 1:3 | 8 | 10 | 500 | 70 | Persulfate | .5 g | 4 min., 25 sec. | 1.371 | Poor | 1.372 | Poor | 0 |
| 119 | Cotton | NBA/DMS 1:3 | 8 | 10 | 500 | 70 | Persulfate | .5 g | 4 min., 25 sec. | 1.367 | Good | 1.368 | Good | 0 |
| 120 | Nylon 6,6 | NBA/DMS 1:3 | 8 | 10 | 500 | 73 | Persulfate | .5 g | 3 min., 20 sec. | 1.418 | Poor | 1.419 | Poor | 0 |
| 121 | Nylon 6,6 | NBA/DMS 1:3 | 8 | 10 | 500 | 75 | Persulfate | .5 g | 2 min., 35 sec. | 1.297 | Poor | 1.301 | Exc. | .3 |
| 122 | Nylon 6,6 | NBA/DMS 1:3 | 8 | 10 | 500 | 77 | Persulfate | .5 g | 1 min., 47 sec. | 1.743 | Poor | 1.749 | Exc. | .3 |
| 123 | Nylon 6,6 | NBA/DMS 1:3 | 8 | 10 | 500 | 80 | Persulfate | .5 g | 1 min., 7 sec. | 1.661 | Poor | 1.667 | Exc. | .4 |
| 124 | Cotton | NBA/DMS 1:3 | 8 | 10 | 500 | 80 | Persulfate | .5 g | 1 min., 7 sec. | 1.525 | Good | 1.526 | Very Good | 0 |
| 125 | Cotton | NBA/DMS 1:3 | 40 | 10 | 500 | 85 | Persulfate | .05 g | 40 sec. | 1.932 | Good | 1.930 | Good | 0 |
| 126 | Cotton | NBA/DMS 1:3 | 15 | 10 | 500 | 87 | Persulfate | .15 g | 3 min., 5 sec. | 1.767 | Good | 1.784 | Very Good | 1.0 |
| 127 | Cotton | NBA/DMS 1:3 | 40 | 10 | 500 | 90 | Persulfate | .05 g | 10 sec. | 2.210 | Good | 2.245 | Very Good | 1.6 |
| 128 | Nylon 6,6 | NBA | 1 | 1 | 500 | 99 | Peroxide (.005 g Fe) | 1 ml | 2 sec. | 1.649 | Poor | 1.653 | Exc. | .2 |
| 129 | Cotton | NBA | 1 | 1 | 500 | 99 | Peroxide (.005 g Fe) | 1 ml | 2 sec. | 1.540 | Good | 1.543 | Exc. | .2 |
| 130 | Nylon 6,6 | NBA | 10 | 10 | 500 | 90 | Peroxide (.005 g Fe) | .5 ml | 7 sec. | 1.234 | Poor | 1.242 | Exc. | .6 |
| 131 | Cotton | NBA | 10 | 10 | 500 | 90 | Peroxide (.005 g Fe) | .5 ml | 7 sec. | 1.451 | Good | 1.489 | Exc. | 2.6 |
| 132 | Cotton | NBA | 10 | 1 | 500 | 87 | Peroxide (.005 g Fe) | .5 ml | 12 sec. | 1.225 | Good | 1.233 | Exc. | .7 |
| 133 | Cotton | NBA | 10 | 1 | 500 | 85 | Peroxide (.005 g Fe) | .5 ml | 9 sec. | 1.188 | Good | 1.187 | Good | 0 |
| 134 | Nylon 6,6 | NBA | 10 | 5 | 500 | 80 | Peroxide (.005 g Fe) | 1 ml | 9 sec. | 1.255 | Poor | 1.262 | Exc. | .6 |
| 135 | Cotton | NBA | 10 | 5 | 500 | 80 | Peroxide (.005 g Fe) | 1 ml | 9 sec. | 1.469 | Good | 1.467 | Good | 0 |
| 136 | Nylon 6,6 | NBA | 10 | 5 | 500 | 77 | Peroxide (.005 g Fe) | 1 ml | 1 min., 25 sec. | 1.275 | Poor | 1.282 | Exc. | .5 |
| 137 | Nylon 6,6 | NBA | 10 | 5 | 500 | 75 | Peroxide (.005 g Fe) | 1 ml | 1 min., 35 sec. | 1.647 | Poor | 1.650 | Very Good | .2 |
| 138 | Nylon 6,6 | NBA | 10 | 5 | 500 | 73 | Peroxide (.005 g Fe) | 1 ml | 1 min., 50 sec. | 1.213 | Poor | 1.214 | Poor | 0 |
| 139 | Nylon 6,6 | NBA | 10 | 10 | 500 | 70 | Peroxide (.005 g Fe) | 5 ml | 1 min., 30 sec. | 1.433 | Poor | 1.433 | Poor | 0 |
| 140 | Cotton | NBA | 10 | 10 | 500 | 70 | Peroxide (.005 g Fe) | 5 ml | 1 min., 30 sec. | 1.949 | Good | 1.948 | Good | 0 |
| 141 | Nylon 6,6 | NBA | 10 | 10 | 500 | 65 | Peroxide (.005 g Fe) | 5 ml | 2 min., 33 sec. | 1.842 | Poor | 1.843 | Poor | 0 |
| 142 | Nylon 6,6 | NBA | 10 | 1 | 500 | 100 | Ceric | .3 g | 4 sec. | 1.242 | Poor | 1.247 | Exc. | .4 |
| 143 | Cotton | NBA | 10 | 1 | 500 | 100 | Ceric | .3 g | 4 sec. | .983 | Good | .994 | Exc. | 1.1 |
| 144 | Nylon 6,6 | NBA | 10 | 1 | 500 | 90 | Ceric | .3 g | 3 min., 45 sec. | 1.101 | Good | 1.109 | Exc. | .7 |
| 145 | Cotton | NBA | 10 | 1 | 500 | 90 | Ceric | .3 g | 3 min., 45 sec. | 1.327 | Good | 1.337 | Very Good | .8 |
| 146 | Cotton | NBA | 10 | 1 | 500 | 87 | Ceric | .3 g | 2 min., 3 sec. | 1.237 | Good | 1.242 | Very Good | .4 |
| 147 | Cotton | NBA | 10 | 1 | 500 | 85 | Ceric | .3 g | — | 1.280 | Good | 1.280 | Good | 0 |
| 148 | Nylon 6,6 | NBA | 20 | 5 | 500 | 80 | Ceric | 1 g | 10 sec. | 1.427 | Poor | 1.432 | Exc. | .4 |
| 149 | Cotton | NBA | 20 | 5 | 500 | 80 | Ceric | 1 g | 10 sec. | 1.458 | Good | 1.460 | Good | 0 |
| 150 | Nylon 6,6 | NBA | 20 | 5 | 500 | 77 | Ceric | 1 g | 25 sec. | 1.289 | Poor | 1.296 | Very Good | .5 |
| 151 | Nylon 6,6 | NBA | 20 | 5 | 500 | 75 | Ceric | 1 g | 30 sec. | 1.288 | Poor | 1.293 | Good | .4 |

TABLE 1-continued

| Ex. No. | Fabric | Monomer | Amt. of Mono-mer, g. | Amt. of Acid, ml | Vol. of Water, ml | Temp., °C. | Initiator | Amt. of Initi-ator | Time to Polymer-ize | Init. Wt., g | Init. Drop Test | Final Wt., g | Final Drop Test | % Add-On |
|---|---|---|---|---|---|---|---|---|---|---|---|---|---|---|
| 152 | Nylon 6,6 | NBA | 20 | 5 | 500 | 73 | Ceric | 1 g | 33 sec. | 1.033 | Poor | 1.034 | Poor | 0 |
| 153 | Nylon 6,6 | NBA | 10 | 10 | 500 | 70 | Ceric | 2 g | 35 sec. | 1.347 | Poor | 1.349 | Poor | 0 |
| 154 | Cotton | NBA | 10 | 10 | 500 | 70 | Ceric | 2 g | 35 sec. | 1.305 | Good | 1.303 | Good | 0 |
| 155 | Nylon 6,6 | NBA | 10 | 10 | 500 | 65 | Ceric | 2 g | 40 sec. | 1.113 | Poor | 1.113 | Poor | 0 |
| 156 | Cotton | NBA | 10 | 10 | 600 | 95–100 | Peroxide | 5 ml | 0–1 min. | 4.23 | Good | 4.47 | Exc. | 5.6 |
| 157 | Wool | NBA | 10 | 10 | 600 | 95–100 | Peroxide | 5 ml | 0–1 min. | 3.45 | Poor | 3.51 | Very Good | 1.7 |
| 158 | Silk | NBA | 10 | 10 | 600 | 95–100 | Peroxide | 5 ml | 0–1 min. | 3.49 | Poor | 3.54 | Good | 1.4 |
| 159 | Cellu-lose (Ray-on) | NBA | 10 | 10 | 600 | 95–100 | Peroxide | 5 ml | 0–1 min. | 8.5 | Poor | 8.68 | Exc. | 2.1 |
| 162 | Nylon 6 | NBA | 10 | 10 | 600 | 95–100 | Peroxide | 5 ml | 0–1 min. | 4.58 | Poor | 4.68 | Exc. | 2.2 |
| 163 | Nylon 6,6 | NBA | 10 | 10 | 600 | 95–11 | Peroxide | 5 ml | 0–1 min. | 4.21 | Poor | 4.30 | Exc. | 2.1 |
| 164 | Ace-tate | NBA | 10 | 10 | 600 | 95–11 | Peroxide | 5 ml | 0–1 min. | 6.1 | Very Good | 6.18 | Exc. | 1.3 |
| 165 | Nylon 6,6 | NBA | 2 | 10 | 600 | 70* | Persulfate | | | 2.61 | Poor | 2.61 | Poor | 0 |
| 166 | Nylon 6,6 | NBA | 2 | 10 | 600 | 73 | Persulfate | | | 2.37 | Poor | 2.37 | Poor | 0 |
| 167 | Nylon 6,6 | NBA | 2 | 10 | 600 | 75 | Persulfate | — | — | 5.71 | Poor | 5.71 | Poor | 0 |
| 168 | Nylon 6,6 | NBA | 2 | 10 | 600 | 77 | Persulfate | — | — | 3.08 | Poor | 3.08 | Good | 0 |
| 169 | Nylon 6,6 | NBA | 2 | 10 | 600 | 80 | Persulfate | — | — | 2.62 | Poor | 2.64 | Exc. | 0.8 |
| 170 | Nylon 6,6 | NBA | 2 | 10 | 600 | 90 | Persulfate | — | — | 3.15 | Poor | 3.18 | Exc. | 1.0 |
| 171 | Nylon 6 | NBA | 2 | 10 | 600 | 73 | Persulfate | — | — | 4.65 | Poor | 4.65 | Poor | 0 |
| 172 | Nylon 6 | NBA | 2 | 10 | 600 | 80 | Persulfate | — | — | 2.77 | Poor | 2.79 | Good | 0.7 |
| 173 | Wool | NBA | 2 | 10 | 600 | 73 | Persulfate | — | — | 4.00 | Poor | 4.00 | Poor | 0 |
| 174 | Wool | NBA | 2 | 10 | 600 | 80 | Persulfate | — | — | 6.22 | Poor | 6.31 | Exc. | 1.4 |
| 175 | Silk | NBA | 2 | 10 | 600 | 73 | Persulfate | — | — | 2.86 | Poor | 2.86 | Poor | 0 |
| 176 | Silk | NBA | 2 | 10 | 600 | 80 | Persulfate | — | — | 2.61 | Poor | 2.64 | Exc. | 1.1 |
| 177 | Cotton | NBA | 2 | 10 | 600 | 70* | Persulfate | — | — | 5.91 | Good | 5.91 | Good | 0 |
| 178 | Cotton | NBA | 2 | 10 | 600 | 75 | Persulfate | — | — | 5.09 | Good | 5.09 | Good | 0 |
| 179 | Cotton | NBA | 2 | 10 | 600 | 80 | Persulfate | — | — | 5.59 | Good | 5.59 | Good | 0 |
| 180 | Cotton | NBA | 2 | 10 | 600 | 85 | Persulfate | — | — | 5.74 | Good | 5.74 | Good | 0 |
| 181 | Cotton | NBA | 2 | 10 | 600 | 87 | Persulfate | — | — | 7.19 | Good | 7.22 | Exc. | 0.4 |
| 182 | Cotton | NBA | 2 | 10 | 600 | 89 | Persulfate | — | — | 5.51 | Good | 5.55 | Exc. | 0.7 |
| 183 | Rayon | NBA | 2 | 10 | 600 | 85 | Persulfate | — | — | 11.29 | Good | 11.29 | Good | 0 |
| 184 | Rayon | NBA | 2 | 10 | 600 | 89 | Persulfate | — | — | 5.50 | Good | 5.55 | Exc. | 0.9 |
| 185 | Ace-tate | NBA | 2 | 10 | 600 | 85 | Persulfate | — | — | 3.84 | Good | 3.84 | Good | 0 |
| 186 | Ace-tate | NBA | 2 | 10 | 600 | 89 | Persulfate | — | — | 4.45 | Good | 4.49 | Exc. | 0.9 |
| 187 | Nylon 6,6 | NBA | 10 | 10 | 600 | 95–100 | Persulfate | — | — | 2.7 | Poor | 2.76 | Exc. | 2.2 |
| 188 | Nylon 6,6 | NEBA | 10 | 10 | 600 | 95–100 | Persulfate | — | — | 3.4 | Poor | 3.48 | Exc. | 2.3 |
| 189 | Nylon 6,6 | NBA/DMS 1:4 | 10 | 10 | 600 | 95–100 | Persulfate | — | — | 2.33 | Poor | 2.41 | Exc. | 3.4 |
| 190 | Nylon 6,6 | Acryl-amide | 10 | 10 | 600 | 95–100 | Ceric | — | — | 4.25 | Poor | 4.30 | Very Poor | 1.2 |
| 191 | Nylon 6,6 | Acrylic Acid | 10 | 10 | 600 | 95–100 | Ceric | — | — | 3.35 | Poor | 3.40 | Very Poor | 1.5 |
| 192 | Nylon 6,6 | 2-propyn-1-OL | 10 | 10 | 600 | 95–100 | Ceric | — | — | 2.65 | Poor | 2.69 | Very Poor | 1.5 |
| 193 | Nylon 6,6 | Crotonic Acid | 10 | 10 | 600 | 95–100 | Ceric | — | — | 2.62 | Poor | 2.71 | Very Poor | 3.4 |
| 194 | Nylon 6,6 | Tetra-ethylene glycol | 10 | 10 | 600 | 95–100 | Ceric | | | 2.10 | Poor | 2.22 | Very Poor | 5.2 |
| 195 | Nylon 6,6 | NBA | 10 | — | 600 | 95–100 | Formic Acid | 25 ml | 2 min. | 4.2 | Poor | 4.31 | Exc. | 2.6 |
| 196 | Nylon 6,6 | NBA | 10 | — | 600 | 95–100 | HCl | 10 ml | 8 sec. | 2.0 | Poor | 2.04 | Exc. | 2.0 |
| 197 | Nylon | NBA | 10 | — | 600 | 95–100 | Sodium | 0.3 g | 1 min., | 3.41 | Poor | 3.45 | Exc. | 1.2 |

TABLE 1-continued

| Ex. No. | Fabric | Monomer | Amt. of Mono-mer, g. | Amt. of Acid, ml | Vol. of Water, ml | Temp., °C. | Initiator | Amt. of Initi-ator | Time to Polymer-ize | Init. Wt., g | Init. Drop Test | Final Wt., g | Final Drop Test | % Add-On |
|---|---|---|---|---|---|---|---|---|---|---|---|---|---|---|
| | 6,6 | | | | | | Peroxide | | 30 sec. | | | | | |

*comparative example

TABLE 2

Fabric: Nylon 6,6

| Ex. No. | Acid/No Acid | Monomer % | Formic % | Temp., °C. | Initiator % | % Add-On | Time to Polymerize |
|---|---|---|---|---|---|---|---|
| 3 | No Acid | NBA 1.67* | 0 | 96–100 | Peroxide 1.9 | 1.2 | 6 min., 15 sec. |
| 5 | Acid | NBA 1.67 | 2 | 96–100 | Peroxide 1.9 | 1.5 | 2 min., 10 sec. |
| 7 | No Acid | NBA 1.67 | 0 | 89–93 | Peroxide .96 | .8 | 47 min., 43 sec. |
| 9 | Acid | NBA 1.67 | 2 | 89–93 | Peroxide .96 | .7 | 6 min., 40 sec. |
| 11 | No Acid | NBA 1.67 | 0 | 89–93 | Peroxide .48 | 1.0 | 83 min., 20 sec. |
| 13 | Acid | NBA 1.67 | 2 | 89–93 | Peroxide .48 | 1.0 | 10 min., 16 sec. |
| 15 | No acid | NBA 1.67 | 0 | 88–92 | Peroxide .19 | .6 | 139 min., 42 sec. |
| 17 | Acid | NBA 1.67 | 2 | 88–92 | Peroxide .19 | .9 | 11 min., 16 sec. |

*NBA is acid having a pH of about 4.5 to 5.0

TABLE 3

Fabric: Nylon 6,6

| Ex. No. | Monomer % | Formic % | Temp., °C. | Initiator % | Time to Polymerize | Final Drop Test | % Add-On |
|---|---|---|---|---|---|---|---|
| 1 | NBA 1.67 | 4.1 | 96–100 | Persulfate .96 | 0.55 sec. | Exc. | .7 |
| 5 | NBA 1.67 | 2 | 96–100 | Peroxide 1.9 | 2 min., 10 sec. | Exc. | 1.5 |
| 3 | NBA 1.67 | 0 | 96–100 | Peroxide 1.9 | 6 min., 15 sec. | Exc. | 1.2 |
| 13 | NBA 1.67 | 2 | 89–93 | Peroxide .48 | 10 min., 16 sec. | Exc. | 1.0 |
| 7 | NBA 1.67 | 0 | 89–93 | Peroxide .96 | 47 min., 43 sec. | Exc. | .8 |
| 11 | NBA 1.67 | 0 | 89–93 | Peroxide .48 | 83 min., 20 sec. | Exc. | 1.0 |
| 15 | NBA 1.67 | 0 | 88–92 | Peroxide .19 | 139 min., 42 sec. | Exc. | .6 |

TABLE 4

Fabric: Nylon 6,6

| Ex. No. | Monomer % | Monomer | Formic % | Temp., °C. | Initiator % | Time to Polymerize | Final Drop Test | % Add-On |
|---|---|---|---|---|---|---|---|---|
| 47 | .01 | NBA | .24 (HCl) | 98–100 | Persulfate .2 | 45 sec. | Exc. | 0 |
| 55 | .03 | NBA/DMS 1:3 | .24 (HCl) | 98–100 | Persulfate .02 | 2 min. | Exc. | 0 |
| 49 | .05 | NBA | 4.9 | 98–100 | Persulfate .006 | 1 min., 50 sec. | Exc. | .2 |
| 57 | 0.1 | NBA/DMS 1:3 | .24 (HCl) | 98–100 | Persulfate .02 | 20 sec. | Exc. | 0 |
| 35 | 0.33 | NBA/MCA 1:2 | 2.0 | 89–92 | Persulfate .008 | 1 min., 13 sec. | Exc. | 1.3 |
| 65 | 0.75 | NBA/Formic 1:4 | .24 (HCl) | 98–100 | Persulfate .002 | 10 sec. | Exc. | 1.0 |
| 61 | 1.5 | NEBA | .24 (HCl) | 98–100 | Persulfate .02 | 6 sec. | Exc. | .6 |
| 67 | 2 | NBA/Formic 1:4 | .24 (HCl) | 98–100 | Persulfate .002 | 4 sec. | Exc. | .2 |
| 59 | 4 | NBA/DMS 1:4 | .24 (HCl) | 98–100 | Persulfate .006 | 30 sec. | Exc. | 1.2 |
| 43 | 5.1 | NEBA/MCA 1:3 | .24 (HCl) | 89–92 | Persulfate .2 | 10 sec. | Exc. | .6 |
| 63 | 7.5 | NEBA/DMS 1:3 | .24 (HCl) | 98–100 | Persulfate .002 | 10 sec. | Exc. | .2 |
| 53 | 10 | NEBA | 0 | 94–96 | Persulfate .002 | 20 sec. | Good | .3 |

TABLE 5

Fabric: Nylon 6,6

| Ex. No. | Monomer % | Temp., °C. | Formic % | Initiator % | Time to Polymerize | Final Drop Test | % Add-On |
|---|---|---|---|---|---|---|---|
| 19 | NBA .17 | 89–92 | 2.0 | Persulfate .017 | 35 sec. | Exc. | .7 |
| 21 | NBA .33 | 69–70 | 2.0 | Persulfate .017 | — | Poor | 0 |

TABLE 5-continued

Fabric: Nylon 6,6

| Ex. No. | Monomer % | Temp., °C. | Formic % | Initiator % | Time to Polymerize | Final Drop Test | % Add-On |
|---|---|---|---|---|---|---|---|
| 23 | NEBA .33 | 89–92 | 4.1 | Persulfate .083 | 4 min., 10 sec. | Exc. | .9 |
| 25 | NEBA .83 | 69–70 | 4.1 | Persulfate .83 | 40 sec. | Poor | 0 |
| 27 | NBA/Formic 1:4 .33 | 89–92 | 2.0 | Persulfate .017 | 40 sec. | Exc. | 1.06 |
| 29 | NBA/Formic 1:4 .33 | 69–70 | 2.0 | Persulfate .083 | 2 min., 55 sec. | Poor | 0 |
| 31 | NBA/DMS 1:3 .33 | 89–92 | 2.0 | Persulfate .017 | 57 sec. | Exc. | 1.4 |
| 33 | NBA/DMS 1:3 .33 | 69–70 | 2.0 | Persulfate .083 | 3 min., 4 sec. | Poor | 0 |
| 35 | NBA/MCA 1:2 .33 | 89–92 | 2.0 | Persulfate .0083 | 1 min., 13 sec. | Exc. | 1.3 |
| 37 | NBA/MCA 1:2 .33 | 69–70 | 2.0 | Persulfate .25 | 2 min., 10 sec. | Poor | 0 |
| 39 | NEBA/ Formic 1:4 .5 | 89–92 | 4.1 | Persulfate .083 | 7 min., 44 sec. | Exc. | .6 |
| 41 | NEBA/ Formic 1:4 .5 | 69–70 | 4.1 | Persulfate .167 | 4 min., 30 sec. | Poor | 0 |
| 43 | NEBA/MCA 1:3 5.12 | 89–92 | .2 (HCl) | Persulfate .2 | 10 sec. | Exc. | .6 |
| 45 | NEBA/MCA 1:3 4.65 | 69–70 | .18 (HCl) | Persulfate .18 | 1 min., 50 sec. | Poor | 0 |

TABLE 6

Fabric: Nylon 6,6

| Ex. No. | Initiator | Monomer % | Temp., °C. | Formic % | Init. % | Time to Polymerize | Final Drop Test | % Add-On |
|---|---|---|---|---|---|---|---|---|
| 3 | Peroxide | NBA 1.67 | 96–100 | 0 | 1.9 | 6 min., 15 sec. | Exc. | 1.2 |
| 84 | Peroxide | NBA 8 | 69–70 | 2.4 | 2.3 | 5 min., 20 sec. | Poor | 0 |
| 90 | Peroxide | NEBA 4 | 89–91 | 0 | 1.15 | 25 sec. | Exc. | 4.2 |
| 92 | Peroxide | NEBA 10 | 69–70 | 2.4 | 2.3 | 6 min., 15 sec. | Poor | 0 |
| 71 | Peroxide | NBA/MCA 1:3 6 | 89–91 | 0 | .23 ml | — | Exc. | .5 |
| 69 | Peroxide | NBA/MCA 1:3 6 | 69–70 | 4.9 | .57 ml | — | Poor | 0 |
| 19 | Persulfate | NBA 1.67 | 89–92 | 2.0 | .017 | 35 sec. | Exc. | .7 |
| 21 | Persulfate | NBA .33 | 69–70 | 2.0 | .017 | — | Poor | 0 |
| 23 | Persulfate | NEBA .33 | 89–92 | 4.1 | .083 | 4 min., 10 sec. | Exc. | .9 |
| 25 | Persulfate | NEBA .83 | 69–70 | 4.1 | .83 | 40 sec. | Poor | 0 |
| 35 | Persulfate | NBA/MCA 1:3 .33 | 89–92 | 2.0 | .0083 | 1 min., 13 sec. | Exc. | 1.3 |
| 33 | Persulfate | NBA/MCA 1:3 .33 | 69–70 | 2.0 | .083 | 3 min., 4 sec. | Poor | 0 |
| 144 | Ceric | NBA 1.6 | 90 | .2 | .05 | 3 min., 45 sec. | Exc. | .7 |
| 86 | Ceric | NBA 6.67 | 69–70 | 2.0 | .33 | 16 sec. | Poor | 0 |
| 94 | Ceric | NEBA 15 | 95–97 | 0 | 1.07 | — | Exc. | 1.3 |
| 96 | Ceric | NEBA 16.7 | 69–70 | 4.1 | 1.67 | — | Poor | 0 |
| 79 | Ceric | NBA/MCA 1:3 5 | 89–91 | 0 | .017 | 15 sec. | Exc. | .8 |
| 77 | Ceric | NBA/MCA 1:3 5 | 69–70 | 6.1 | 0.17 | 35 sec. | Poor | 0 |
| 195 | Formic | NBA 1.67 | 95–100 | — | 5.08 | 2 min. | Exc. | 2.6 |
| 88 | Formic | NEBA 4 | 98–100 | 0 | 7.3 | — | Exc. | 1.3 |
| 75 | Formic | NBA/MCA 1:3 6 | 98–100 | 0 | 9.76 | — | Exc. | .3 |

TABLE 7

Fabric: Nylon 6,6

| Ex. No. | Temp., °C. | Monomer % | Formic % | Initiator % | Time to Polymerize | Final Drop Test | % Add-On |
|---|---|---|---|---|---|---|---|
| 100 | 65 | NBA 2 | 4.88 | Persulfate .05 | 6 min., 35 sec. | Poor | 0 |
| 165 | 70 | NBA .33 | 2.0 | Persulfate | — | Poor | 0 |
| 166 | 73 | NBA .33 | 2.0 | Persulfate | — | Poor | 0 |
| 167 | 75 | NBA .33 | 2.0 | Persulfate | — | Good | 0 |
| 168 | 77 | NBA .33 | 2.0 | Persulfate | — | Exc. | 0 |
| 169 | 80 | NBA .33 | 2.0 | Persulfate | — | Exc. | .8 |

TABLE 7-continued

Fabric: Nylon 6,6

| Ex. No. | Temp., °C. | Monomer % | Formic % | Initiator % | Time to Polymerize | Final Drop Test | % Add-On |
|---|---|---|---|---|---|---|---|
| 170 | 90 | NBA .33 | 2.0 | Persulfate | — | Exc. | 1.0 |
| 101 | 100 | NBA .4 | .24 | Persulfate .006 | 6 sec. | Exc. | .4 |

TABLE 8

Fabric: Nylon 6,6

| Ex. No. | Temp., °C. | Monomer % | Formic % | Initiator % | Time to Polymerize | Final Drop Test | % Add-On |
|---|---|---|---|---|---|---|---|
| 117 | 65 | NBA/DMS 1:3 1.6 | 2.44 | Persulfate .4 | 4 min., 30 sec. | Poor | 0 |
| 118 | 70 | NBA/DMS 1:3 1.6 | 2.44 | Persulfate .1 | 4 min., 25 sec. | Poor | 0 |
| 120 | 73 | NBA/DMS 1:3 1.6 | 2.44 | Persulfate .1 | 3 min., 20 sec. | Poor | 0 |
| 121 | 75 | NBA/DMS 1:3 1.6 | 2.44 | Persulfate .1 | 2 min., 35 sec. | Exc. | .3 |
| 122 | 77 | NBA/DMS 1:3 1.6 | 2.44 | Persulfate .1 | 1 min., 47 sec. | Exc. | .3 |
| 123 | 80 | NBA/DMS 1:3 1.6 | 2.44 | Persulfate .1 | 1 min., 7 sec. | Exc. | .4 |
| 31 | 89–92 | NBA/DMS 1:3 .4 | 2.44 | Persulfate .02 | 57 sec. | Exc. | 1.4 |
| 59 | 98–100 | NBA/DMS 1:3 4 | .24 (HCl) | Persulfate .006 | 30 sec. | Exc. | 1.2 |

TABLE 9

Fabric: Nylon 6,6

| Ex. No. | Temp., °C. | Monomer % | Formic % | Initiator % | Time to Polymerize | Final Drop Test | % Add-On |
|---|---|---|---|---|---|---|---|
| 103 | 65 | NEBA 1 | 4.88 | Persulfate .4 | 1 min., 55 sec. | Poor | 0 |
| 104 | 70 | NEBA 1 | 4.88 | Persulfate .4 | 55 sec. | Poor | 0 |
| 106 | 73 | NEBA 1 | 4.88 | Persulfate .4 | 48 sec. | Poor | 0 |
| 107 | 75 | NEBA 1 | 4.88 | Persulfate .4 | 40 sec. | Very Good | 0 |
| 108 | 77 | NEBA 1 | 4.88 | Persulfate .4 | 20 sec. | Exc. | 0 |
| 109 | 80 | NEBA 1 | 4.88 | Persulfate .1 | 58 sec. | Exc. | .2 |
| 113 | 90 | NEBA .6 | .49 | Persulfate .1 | 10 sec. | Exc. | .3 |
| 115 | 100 | NEBA 2 | 4.88 | Persulfate .4 | — | Exc. | .6 |

TABLE 10

Fabric: Nylon 6,6

| Ex. No. | Temp., °C. | Initiator % | Formic % | Monomer % | Time to Polymerize | Final Drop Test | % Add-On |
|---|---|---|---|---|---|---|---|
| 141 | 65 | Peroxide 1.15 | 2.44 | NBA 2 | 2 min., 33 sec. | Poor | 0 |
| 139 | 70 | Peroxide 1.15 | 2.44 | NBA 2 | 1 min., 30 sec. | Poor | 0 |
| 138 | 73 | Peroxide .23 | 1.22 | NBA 2 | 1 min., 50 sec. | Poor | 0 |
| 137 | 75 | Peroxide .23 | 1.22 | NBA 2 | 1 min., 35 sec. | Very Good | .2 |
| 136 | 77 | Peroxide .23 | 1.22 | NBA 2 | 1 min., 25 sec. | Exc. | .5 |
| 134 | 80 | Peroxide .23 | 1.22 | NBA 2 | 9 sec. | Exc. | .6 |
| 130 | 90 | Peroxide .12 | 2.44 | NBA 2 | 7 sec. | Exc. | .6 |
| 128 | 99 | Peroxide .23 | .24 | NBA 2 | 2 sec. | Exc. | .2 |

TABLE 11

Fabric: Nylon 6.6

| Ex. No. | Temp., °C. | Initiator % | Formic % | Monomer % | Time to Polymerize | Final Drop Test | % Add-On |
|---|---|---|---|---|---|---|---|
| 155 | 65 | Ceric .4 | 2.44 | NBA 2 | 40 sec. | Poor | 0 |
| 153 | 70 | Ceric .4 | 2.44 | NBA 2 | 35 sec. | Poor | 0 |
| 152 | 73 | Ceric .2 | 1.22 | NBA 4 | 33 sec. | Poor | 0 |
| 151 | 75 | Ceric .2 | 1.22 | NBA 4 | 30 sec. | Good | .4 |
| 150 | 77 | Ceric .2 | 1.22 | NBA 4 | 25 sec. | Very Good | .5 |
| 148 | 80 | Ceric .2 | 1.22 | NBA 4 | 10 sec. | Exc. | .4 |
| 144 | 90 | Ceric .06 | .24 | NBA 2 | 3 min., 45 sec. | Exc. | .7 |
| 142 | 100 | Ceric .06 | .24 | NBA 2 | 4 sec. | Exc. | .4 |

TABLE 12

Fabric: Cotton

| Ex. No. | Acid/ No Acid | Monomer % | Formic % | Temp., °C. | Initiator % | % Add-On | Time to Polymerize |
|---|---|---|---|---|---|---|---|
| 4 | No Acid | NBA 1.67 | 0 | 96–100 | Peroxide 1.9 | .9 | 6 min., 15 sec. |
| 6 | Acid | NBA 1.67 | 2 | 96–100 | Peroxide 1.9 | 1.9 | 2 min., 10 sec. |
| 8 | No Acid | NBA 1.67 | 0 | 89–93 | Peroxide .96 | 3.1 | 47 min., 43 sec. |
| 10 | Acid | NBA 1.67 | 2 | 89–93 | Peroxide .96 | 1.5 | 6 min., 40 sec. |
| 12 | No Acid | NBA 1.67 | 0 | 89–93 | Peroxide .48 | 2.3 | 83 min., 20 sec. |
| 14 | Acid | NBA 1.67 | 2 | 89–93 | Peroxide .48 | 2.4 | 10 min., 16 sec. |
| 16 | No Acid | NBA 1.67 | 0 | 88–92 | Peroxide .19 | 2.3 | 139 min., 42 sec. |
| 18 | Acid | NBA 1.67 | 2 | 88–92 | Peroxide .19 | 2.2 | 11 min., 16 sec. |

TABLE 13

Fabric: Cotton

| Ex. No. | Monomer % | Formic % | Temp., °C. | Initiator % | Time to Polymerize | Final Drop Test | % Add-On |
|---|---|---|---|---|---|---|---|
| 2 | NBA 1.67 | 4.1 | 96–100 | Persulfate .96 | 0.5 sec. | Exc. | 1.8 |
| 6 | NBA 1.67 | 2 | 96–100 | Peroxide 1.9 | 2 min., 10 sec. | Exc. | 1.9 |
| 4 | NBA 1.67 | 0 | 96–100 | Peroxide 1.9 | 6 min., 15 sec. | Exc. | .9 |
| 14 | NBA 1.67 | 2 | 89–93 | Peroxide .48 | 10 min., 16 sec. | Exc. | 2.4 |
| 8 | NBA 1.67 | 0 | 89–93 | Peroxide .96 | 47 min., 43 sec. | Exc. | 3.1 |
| 12 | NBA 1.67 | 0 | 89–93 | Peroxide .48 | 83 min., 20 sec. | Exc. | 2.3 |
| 16 | NBA 1.67 | 0 | 88–92 | Peroxide .19 | 139 min., 42 sec. | Exc. | 2.3 |

TABLE 14

Fabric: Cotton

| Ex. No. | Monomer % | Monomer | Formic % | Temp., °C. | Initiator % | Time to Polymerize | Final Drop Test | % Add-On |
|---|---|---|---|---|---|---|---|---|
| 48 | .01 | NBA | .24 (HCl) | 98–100 | Persulfate .2 | 45 sec. | Exc. | 0 |
| 56 | .03 | NBA/DMS 1:3 | .24 (HCl) | 98–100 | Persulfate .02 | 2 min. | Exc. | 0 |
| 50 | .05 | NBA | 4.9 | 98–100 | Persulfate .006 | 1 min., 50 sec. | Exc. | 0 |
| 58 | .1 | NBA/DMS 1:3 | .24 (HCl) | 98–100 | Persulfate .02 | 20 sec. | Exc. | .4 |
| 36 | .33 | NBA/MCA 1:2 | 2.0 | 89–92 | Persulfate .008 | 1 min., 13 sec. | Exc. | 1.3 |
| 66 | .75 | NBA/Formic 1:4 | .24 (HCl) | 98–100 | Persulfate .002 | 10 sec. | Exc. | 4.4 |
| 62 | 1.5 | NEBA | .24 (HCl) | 98–100 | Persulfate .02 | 6 sec. | Exc. | .5 |
| 68 | 2 | NBA/Formic 1:4 | .24 (HCl) | 98–100 | Persulfate .002 | 4 sec. | Exc. | .6 |
| 60 | 4 | NBS/DMS 1:4 | .24 (HCl) | 98–100 | Persulfate .006 | 30 sec. | Exc. | 4.2 |
| 44 | 5.1 | NEBA/MCA 1:3 | .24 (HCl) | 89–92 | Persulfate .2 | 10 sec. | Exc. | .6 |
| 64 | 7.5 | NEBA/DMS 1:3 | .24 (HCl) | 98–100 | Persulfate .002 | 10 sec. | Exc. | 1.1 |
| 54 | 10 | NEBA | 0 | 94–96 | Persulfate .002 | 20 sec. | Exc. | 12.5 |

TABLE 15

Fabric: Cotton

| Ex. No. | Monomer % | Temp., °C. | Formic % | Initiator % | Time to Polymerize | Final Drop Test | % Add-On |
|---|---|---|---|---|---|---|---|
| 20 | NBA .17 | 89–92 | 2 | Persulfate .017 | 35 sec. | Exc. | .6 |
| 22 | NBA .33 | 69–70 | 2 | Persulfate .017 | — | Good | 0 |
| 24 | NEBA .33 | 89–92 | 4.1 | Persulfate .083 | 4 min., 10 sec. | Exc. | .6 |
| 26 | ENBA .83 | 69–70 | 4.1 | Persulfate .83 | 40 sec. | Good | 0 |
| 28 | NBA/Formic 1:4 .33 | 89–92 | 2 | Persulfate .017 | 40 sec. | Exc. | .8 |
| 30 | NBA/Formic 1:4 .33 | 69–70 | 2 | Persulfate .083 | 2 min., 55 sec. | Good | 0 |
| 32 | NBA/DMS 1:3 .33 | 89–92 | 2 | Persulfate .017 | 57 sec. | Exc. | 1.5 |
| 34 | NBA/DMS 1:3 .33 | 69–70 | 2 | Persulfate .083 | 3 min., 4 sec. | Good | 0 |
| 36 | NBA/MCA 1:2 .33 | 89–92 | 2 | Persulfate .0083 | 1 min., 13 sec. | Exc. | 1.3 |
| 38 | MBA/MCA 1:2 .33 | 69–70 | 2 | Persulfate .25 | 2 min., 10 sec. | Good | 0 |
| 40 | NEBA/Formic 1:4 .5 | 89–92 | 4.1 | Persulfate .083 | 7 min., 44 sec. | Exc. | .6 |
| 42 | NEBA/Formic 1:4 .5 | 69–70 | 4.1 | Persulfate .167 | 4 min., 30 sec. | Good | 0 |
| 44 | NEBA/MCA 1:3 5.12 | 89–92 | .2 (HCl) | Persulfate .2 | 10 sec. | Exc. | .6 |
| 46 | MEBA/MCA 1:3 4.65 | 69–70 | .18 (HCl) | Persulfate .18 | 1 min., 50 sec. | Good | 0 |

TABLE 16

Fabric: Cotton

| Ex. No. | Initiator | Monomer % | Temp., °C. | Formic % | Init. % | Time to Polymerize | Final Drop Test | % Add-On |
|---|---|---|---|---|---|---|---|---|
| 4 | Peroxide | NBA 1.67 | 96–100 | 0 | 1.9 | 6 min., 15 sec. | Exc. | .9 |
| 85 | Peroxide | NBA 8 | 69–70 | 2.4 | 2.3 | 5 min., 20 sec. | Good | 0 |
| 91 | Peroxide | NEBA 4 | 89–91 | 0 | 1.15 | 25 sec. | Exc. | 2.4 |
| 93 | Peroxide | NEBA 10 | 69–70 | 2.4 | 2.3 | 6 min., 15 sec. | Good | 0 |
| 72 | Peroxide | NBA/MCA 1:3 6 | 89–91 | 0 | .23 | — | Exc. | .5 |
| 70 | Peroxide | NBA/MCA 1:3 6 | 69–70 | 4.9 | .57 | — | Good | 0 |
| 20 | Persulfate | NBA .167 | 89–92 | 2.0 | .017 | 35 sec. | Exc. | .6 |
| 22 | Persulfate | NBA .33 | 69–70 | 2.0 | .017 | — | Good | 0 |
| 24 | Persulfate | NEBA .33 | 89–92 | 4.1 | .083 | 4 min., 10 sec. | Exc. | .6 |
| 26 | Persulfate | NEBA .83 | 69–70 | 4.1 | .83 | 40 sec. | Good | 0 |
| 36 | Persulfate | NBA/MCA | 89–92 | 2.0 | .0083 | 1 min., 13 sec. | Exc. | 1.3 |
| 34 | Persulfate | NBA/MCA 1:3 .33 | 69–70 | 2.0 | .083 | 3 min., 4 sec. | Good | 0 |
| 145 | Ceric | NBA 1.6 | 90 | .2 | .05 | 3 min., 45 sec. | Very Good | .8 |
| 87 | Ceric | NBA 6.67 | 69–70 | 2.0 | .33 | 16 sec. | Good | 0 |
| 95 | Ceric | NEBA 15 | 95–97 | 0 | 1.07 | — | Exc. | 1.0 |
| 97 | Ceric | NEBA 16.7 | 69–70 | 4.1 | 1.67 | — | Good | 0 |
| 80 | Ceric | NBA/MCA 1:3 5 | 89–91 | 0 | .017 | 15 sec. | Exc. | .6 |
| 78 | Ceric | NBA/MCA 1:3 5 | 69–70 | 6.1 | .017 | 35 sec. | Good | 0 |
| 81 | Formic | NBA 2 | 98–100 | 0 | 9.76 | — | Exc. | 1.0 |
| 89 | Formic | NEBA 4 | 98–100 | 0 | 7.3 | — | Exc. | 1.2 |
| 76 | Formmic | NBA/MCA 1:3 6 | 98–100 | 0 | 9.76 | — | Exc. | .3 |

TABLE 17

Fabric: Cotton

| Ex. No. | Temp., °C. | Monomer % | Formic % | Initiator % | Time to Polymerize | Final Drop Test | % Add-On |
|---|---|---|---|---|---|---|---|
| 177 | 70 | NBA .33 | 2.0 | Persulfate | — | Good | 0 |
| 179 | 80 | NBA .33 | 2.0 | Persulfate | — | Good | 0 |
| 180 | 85 | NBA .33 | 2.0 | Persulfate | — | Good | 0 |
| 181 | 87 | NBA .33 | 2.0 | Persulfate | — | Exc. | .4 |
| 182 | 89 | NBA .33 | 2.0 | Persulfate | — | Exc. | .7 |

TABLE 17-continued

Fabric: Cotton

| Ex. No. | Temp., °C. | Monomer % | Formic % | Initiator % | Time to Polymerize | Final Drop Test | % Add-On |
|---|---|---|---|---|---|---|---|
| 102 | 100 | NBA .4 | .24 | Persulfate .006 | 6 sec. | Exc. | .3 |

TABLE 18

Fabric: Cotton

| Ex. No. | Temp., °C. | Monomer % | Formic % | Initiator % | Time to Polymerize | Final Drop Test | % Add-On |
|---|---|---|---|---|---|---|---|
| 119 | 70 | NBA/DMS 1:3 1.6 | 2.44 | Persulfate .1 | 4 min., 25 sec. | Good | 0 |
| 124 | 80 | NBA/DMS 1:3 1.6 | 2.44 | Persulfate .1 | 1 min., 7 sec. | Very Good | 0 |
| 125 | 85 | NBA/DMS 1:3 8 | 2.44 | Persulfate .01 | 40 sec. | Good | 0 |
| 126 | 87 | NBA/DMS 1:3 3 | 2.44 | Persulfate .03 | 3 min., 5 sec. | Very Good | 1.0 |
| 127 | 90 | NBA/DMS 1:3 8 | 2.44 | Persulfate .01 | 10 sec. | Very Good | 1.6 |
| 60 | 98-100 | NBA/DMS 1:3 4 | .24 (HCl) | Persulfate .006 | 30 sec. | Exc. | 4.2 |

TABLE 19

Fabric: Cotton

| Ex. No. | Temp., °C. | Monomer % | Formic % | Initiator % | Time to Polymerize | Final Drop Test | % Add-On |
|---|---|---|---|---|---|---|---|
| 105 | 70 | NEBA 1 | 4.88 | Persulfate .4 | 55 sec. | Good | 0 |
| 110 | 80 | NEBA .4 | 4.88 | Persulfate .1 | 58 sec. | Good | 0 |
| 111 | 85 | NEBA .6 | 4.88 | Persulfate .1 | 35 sec. | Good | 0 |
| 112 | 87 | NEBA .6 | 4.88 | Persulfate .1 | 20 sec. | Exc. | .3 |
| 114 | 90 | NEBA .6 | .49 | Persulfate .1 | 10 sec. | Exc. | .7 |
| 116 | 100 | NEBA 2 | 4.88 | Persulfate .4 | — | Exc. | 1.1 |

TABLE 20

Fabric: Cotton

| Ex. No. | Temp., °C. | Initiator % | Formic % | Monomer % | Time to Polymerize | Final Drop Test | % Add-On |
|---|---|---|---|---|---|---|---|
| 140 | 70 | Peroxide 1.15 | 2.44 | NBA 2 | 1 min., 30 sec. | Good | 0 |
| 135 | 80 | Peroxide .23 | 1.22 | NBA 2 | 9 sec. | Good | 0 |
| 133 | 85 | Peroxide .12 | .24 | NBA 2 | 9 sec. | Good | 0 |
| 132 | 87 | Peroxide .12 | .24 | NBA 2 | 12 sec. | Exc. | .7 |
| 131 | 90 | Peroxide .12 | 2.44 | NBA 2 | 7 sec. | Exc. | 2.6 |
| 129 | 99 | Peroxide .23 | .24 | NBA .2 | 2 sec. | Exc. | .2 |

TABLE 21

Fabric: Cotton

| Ex. No. | Temp., °C. | Initiator % | Formic % | Monomer % | Time to Polymerize | Final Drop Test | % Add-On |
|---|---|---|---|---|---|---|---|
| 154 | 70 | Ceric .4 | 2.44 | NBA 2 | 35 sec. | Good | 0 |
| 149 | 80 | Ceric .2 | 1.22 | NBA 4 | 10 sec. | Good | 0 |
| 147 | 85 | Ceric .06 | 0.24 | NBA 2 | — | Good | 0 |
| 146 | 87 | Ceric .06 | 0.24 | NBA 2 | 2 min., 3 sec. | Very Good | .4 |
| 145 | 90 | Ceric .06 | 0.24 | NBA 2 | 3 min., 45 sec. | Very Good | .8 |
| 143 | 100 | Ceric .06 | 0.24 | NBA 2 | 4 sec. | Exc. | 1.1 |

TABLE 22

WASH TEST

| Example No. | Type of Fabric | Number of Washings | % Add-On |
|---|---|---|---|
| 198 | Cotton | 0 | 4.7 |
| 199 | Nylon 6,6 | 0 | 3.9 |
| 200 | Cotton | 2 | 2.1 |
| 201 | Nylon 6,6 | 2 | 0.5 |
| 202 | Cotton | 5 | 1.3 |
| 203 | Nylon 6,6 | 5 | 0.4 |
| 204 | Cotton | 10 | 1.2 |
| 205 | Nylon 6,6 | 10 | 0.4 |
| 206 | Cotton | 15 | 1.2 |
| 207 | Nylon 6,6 | 15 | 0.3 |

A graph of Table 22 is annexed revealing the effect of washings on percent add-on.

The present invention may be embodied in other specific forms without departing from the spirit or essential attributes thereof and, accordingly, reference should be made to the appended claims, rather than to the foregoing specification, as indicating the scope of the invention.

I claim:

1. A method of treating polymer fibers containing active hydrogen atoms to improve the hygroscopic, dye receptive and other surface properties of the fibers, comprising the steps of:

(a) contacting fibers having amino or hydroxy groups with an acidic aqueous solution heated to a temperature of about 75° C. to about 100° C. comprising a polymerization initiator, at least one unsaturated monomer and having a pH of below about 7 for a period of time sufficient to allow intimate contact of the monomer with the fiber surfaces, (b) thereafter initiating polymerization of the unsaturated monomer on the fibers by means of said polymerization initiator, and (c) continuing polymerization of the monomer on the fibers until substantial polymerization has occurred to modify surface properties of the fibers.

2. The method according to claim 1 wherein the pH of the aqueous solution is established and maintained below about 7 by addition of acid in step (a).

3. The method of claim 2 wherein said acid is selected from the group consisting of formic, hydrochloric, phosphoric, sulfuric, nitric, acetic, formic, oxalic, tartaric, monochloroacetic, dichloroacetic and trichloroacetic.

4. The method according to claim 1 wherein the pH of the aqueous solution is established and maintained below about 7 by using an acidic monomer.

5. The method according to claim 1 wherein the pH of the solution is maintained below about 7 and the temperature of the solution is maintained between about 75° C. and 100° C. during step (b) and (c).

6. The method according to claim 1 wherein the polymerization is continued for a period not exceeding about 30 minutes.

7. The method according to claim 1 wherein said fibers are scoured and rinsed prior to step (a).

8. The method according to claim 1 wherein said fibers are made of a polymer containing amine groups, said polymer selected from the group consisting of nylon 6, wool, silk and nylon 6,6.

9. The method according to claim 8 wherein the solution is heated in step (a) to a temperature of about 80° C.

10. The method according to claim 1 wherein said fibers contain hydroxy groups, said fibers selected from the group consisting of cotton, rayon and acetate.

11. The method according to claim 10 wherein said monomer is selected from the group consisting of N,N'-methylene-bis-acrylamide and N,N'-(1,2-dihydroxyethylene)-bis-acrylamide.

12. The method according to claim 10 wherein the solution is heated in step (a) to a temperature of about 85° C. to about 100° C.

13. The method according to claim 12 wherein said monomer is selected from the group consisting of N,N'-methylene-bis-acrylamide and N,N'-(1,2-dihydroxyethylene)-bis-acrylamide.

14. The method of claim 1 which further comprises rinsing said fibers or fibrous structures after substantial polymerization has occurred to neutralize the pH and remove any excess homopolymers.

15. The method of claim 1 wherein said initiator is selected from the group consisting of peroxides, persulfates, organic and inorganic acids and ceric salts.

16. The method of claim 1 wherein said monomer is selected from the group consisting of N,N'-methylene-bis-acrylamide; N,N'-(1,2-dihydroxyethylene)-bis-acrylamide; reaction products of dimethyl sulfate, monochloroacetic acid, and formic acid with N,N'-methylene-bis-acrylamide and N,N'-(1,2-dihydroxyethylene)-bis-acrylamide; acrylic acid; 2-propyn-1-ol; crotonic acid and tetraethylene glycol.

17. The method of claim 1 wherein the amount of said monomer is between about 0.1 weight percent and about 10.0 weight percent based on the total weight of said solution.

18. The method of claim 1 wherein the amount of said monomer is between about 0.02 weight percent and about 0.5 weight percent based on the total weight of said solution.

19. The method of claim 1 wherein said polymerization has a duration of between about 0.5 minutes and about 2.0 hours.

20. The method of claim 1 wherein said polymerization has a duration of between about 1.0 minute and about 30 minutes.

21. The method of claim 1, in which said polymer fibers are formed from a synthetic polymer and after polymerization said polymer comprises about 0.2 to about 1.0 weight percent of said polymerized monomer attached to said fibers to improve the hygroscopic, dye receptive and other surface properties of the fibers.

22. The method according to claim 1, wherein the polymer fiber is a nylon and said polymer comprises about 0.2% to about 1.0% or less of said polymerized monomer attached to said fiber.

23. The method according to claim 1 wherein the nylon is selected from the group consisting of nylon 6 and nylon 6,6.

24. The method of claim 1, wherein said initiator is a ceric salt selected from the group consisting of ceric nitrate, ceric sulfate, ceric ammonium nitrate, ceric ammonium sulfate, ceric ammonium pyrophosphate and ceric iodate.

25. A method of treating polymer fibers containing active hydrogen atoms to improve the hygroscopic, dye receptive and other surface properties of the fibers, comprising the steps:

(a) contacting fibers having amino or hydroxy groups with an acidic aqueous solution heated to a temperature of about 75° C. to about 100° C. containing at least one unsaturated monomer;

(b) contacting said fibers with a polymerization initiator;

(c) thereafter initiating polymerization of the unsaturated monomer on the fibers by means of a polymerization initiator for the monomer; and (d) continuing the polymerization of the monomer on the fibers until substantial polymerization has occurred.

26. The method according to claim 25 wherein the polymer is a polyamide.

27. The method according to claim 26 wherein the polyamide is selected from the group consisting of nylon 6 and nylon 6,6.

28. The method according to claim 26 wherein said fibers after polymerization comprise about 0.2 to about 1.0 weight percent of said polymerized monomer attached to said fibers.

29. The polymer fiber product produced by the method of claims 1, 2, 4, 5, 6, 7, 14, 15, 16, 17, 18, 19, 20, 3, 11, 13, 21, 22 or 25.

30. The polymer fiber product produced by the method of claims 8, 9, 23, 26, 27 or 28.

31. The polymer fiber product produced by the method of claims 10 or 12.

* * * * *